US010876436B2

(12) United States Patent
Vance

(10) Patent No.: US 10,876,436 B2
(45) Date of Patent: Dec. 29, 2020

(54) THREE ROLLER ROCKER ARM WITH CANTILEVERED ROLLERS AND LOST MOTION SPRING OVER VALVE OR OVER ROCKER ARM PIVOT

(71) Applicant: Eaton Intelligent Power Limited, Dublin (IE)

(72) Inventor: Matthew A. Vance, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/340,176

(22) PCT Filed: Oct. 9, 2017

(86) PCT No.: PCT/US2017/055766
§ 371 (c)(1),
(2) Date: Apr. 8, 2019

(87) PCT Pub. No.: WO2018/068041
PCT Pub. Date: Apr. 12, 2018

(65) Prior Publication Data

US 2019/0309660 A1 Oct. 10, 2019

Related U.S. Application Data

(60) Provisional application No. 62/554,909, filed on Sep. 6, 2017, provisional application No. 62/549,471, filed
(Continued)

(51) Int. Cl.
*F01L 1/34* (2006.01)
*F01L 3/00* (2006.01)
(Continued)

(52) U.S. Cl.
CPC ..... *F01L 3/00* (2013.01); *F01L 1/04* (2013.01); *F01L 1/185* (2013.01); *F01L 1/20* (2013.01);
(Continued)

(58) Field of Classification Search
CPC ..... F01L 1/185; F01L 1/20; F01L 1/04; F01L 1/2405; F01L 1/46; F01L 3/00;
(Continued)

(56) References Cited

U.S. PATENT DOCUMENTS 5,544,626 A 8/1996 Diggs et al.
6,314,928 B1 11/2001 Baraszu et al.
(Continued)

FOREIGN PATENT DOCUMENTS

WO WO 2013156610 A1 10/2013
WO WO 20130156610 A1 10/2013
(Continued)

OTHER PUBLICATIONS

International Search Report for PCT/US2017/055788; dated Jan. 24, 2018; pp. 1-4.
(Continued)

*Primary Examiner* — Zelalem Eshete
(74) *Attorney, Agent, or Firm* — Mei & Mark, LLP

(57) ABSTRACT

A rocker arm, comprises a first outer arm comprising a first inner side and a first outer side, the first outer side comprising a first cantilevered post. A first outer roller is mounted to the first cantilevered post. A second outer arm comprises a
(Continued)

second inner side and a second outer side, the second inner side facing the first inner side, the second outer side comprising a second cantilevered post. A second outer roller is mounted to the second cantilevered post. A pivot body joins the first inner side to the second inner side. An actuatable latch mechanism is within the pivot body. An inner arm assembly comprises a latch arm, the latch arm pivotable adjacent the pivot body. A pivot axle joins the inner arm assembly to pivot between the first outer arm and the second outer arm.

39 Claims, 18 Drawing Sheets

Related U.S. Application Data on Aug. 24, 2017, provisional application No. 62/506,469, filed on May 15, 2017, provisional application No. 62/473,864, filed on Mar. 20, 2017, provisional application No. 62/473,890, filed on Mar. 20, 2017, provisional application No. 62/473,918, filed on Mar. 20, 2017, provisional application No. 62/472,388, filed on Mar. 16, 2017, provisional application No. 62/405,690, filed on Oct. 7, 2016.

(51) Int. Cl.

| | |
|---|---|
| ***F01L 1/04*** | (2006.01) |
| ***F01L 1/20*** | (2006.01) |
| ***F01L 1/18*** | (2006.01) |
| ***F01L 1/24*** | (2006.01) |
| ***F01L 1/46*** | (2006.01) |
| ***F01L 13/00*** | (2006.01) |

(52) U.S. Cl.

CPC ..... *F01L 1/2405* (2013.01); *F01L 1/46* (2013.01); *F01L 13/0036* (2013.01); *F01L 2001/186* (2013.01); *F01L 2001/467* (2013.01); *F01L 2003/11* (2013.01); *F01L 2013/001* (2013.01)

(58) Field of Classification Search

CPC ..... F01L 13/0036; F01L 2001/467; F01L 2001/186; F01L 2003/11; F01L 2013/001

See application file for complete search history.

(56) References Cited

U.S. PATENT DOCUMENTS 6,325,030 B1 12/2001 Spath et al.
6,439,179 B2 8/2002 Hendriksma et al.
6,481,400 B2 11/2002 Hendriksma et al.
6,502,536 B2 1/2003 Lee et al.
6,532,920 B1 3/2003 Sweetnam et al.
6,604,498 B2 * 8/2003 Fernandez ..... F01L 1/182 123/90.16
6,901,894 B2 6/2005 Haas et al.
6,948,466 B2 9/2005 Haas et al.
7,318,402 B2 1/2008 Harman et al.
7,377,247 B2 5/2008 Seitz
7,484,487 B2 2/2009 Zurface et al.
7,712,443 B2 5/2010 Gemein
7,798,112 B2 9/2010 Zurface et al.
7,798,113 B2 9/2010 Fischer et al.
7,882,814 B2 2/2011 Spath
8,215,275 B2 7/2012 Church
8,251,032 B2 8/2012 Manther
8,327,750 B2 12/2012 Keller et al.
8,534,182 B2 9/2013 Keller et al.
8,607,753 B2 12/2013 Krause et al.
8,635,980 B2 1/2014 Church
8,726,862 B2 5/2014 Zurface et al.
8,752,513 B2 6/2014 Zurface et al.
8,783,219 B2 7/2014 Gunnel et al.
8,915,225 B2 12/2014 Zurface et al.
8,985,074 B2 3/2015 Zurface et al.
9,016,252 B2 4/2015 Zurface et al.
9,038,586 B2 5/2015 Schultheis et al.
9,194,260 B2 11/2015 Zurface
9,194,261 B2 11/2015 McCarthy, Jr.
9,228,454 B2 1/2016 VanDeusen
9,267,396 B2 2/2016 Zurface et al.
9,284,859 B2 3/2016 Nielse et al.
9,291,075 B2 3/2016 Zurface et al.
9,470,116 B2 10/2016 Cecur
9,581,058 B2 2/2017 Radulescu et al.
9,644,503 B2 5/2017 Zurface et al.
9,664,075 B2 5/2017 McCarthy, Jr.
9,702,279 B2 7/2017 Zurface et al.
9,708,942 B2 7/2017 Zurface et al.
9,726,052 B2 8/2017 Zurface et al.
9,765,657 B2 9/2017 VanDeusen
9,790,823 B2 10/2017 Zurface
10,253,657 B2 4/2019 Uckermark et al.
2001/0023675 A1 9/2001 Lee et al.
2001/0027765 A1 10/2001 Hendriksma et al.
2002/0011225 A1 1/2002 Hendriksma et al.
2004/0035381 A1 2/2004 Burch et al.
2004/0237919 A1 12/2004 Haas et al.
2005/0132989 A1 6/2005 Hendriksma
2005/0132990 A1 6/2005 Haas et al.
2006/0157008 A1 7/2006 Lechner et al.
2007/0101958 A1 5/2007 Seitz
2007/0113809 A1 5/2007 Harman et al.
2007/0186890 A1 8/2007 Zurface et al.
2007/0283914 A1 12/2007 Zurface et al.
2009/0217895 A1 9/2009 Spath
2010/0018482 A1 1/2010 Keller et al.
2010/0319657 A1 12/2010 Dodi et al.
2011/0226208 A1 9/2011 Zurface et al.
2011/0226209 A1 9/2011 Zurface et al.
2012/0037107 A1 * 2/2012 Church ..... F01L 1/185 123/90.41
2012/0260875 A1 10/2012 Moeck et al.
2013/0000582 A1 1/2013 Church
2013/0068182 A1 3/2013 Keller et al.
2013/0146008 A1 6/2013 Stoody
2013/0220250 A1 8/2013 Gunnel et al.
2013/0233265 A1 9/2013 Zurface et al.
2013/0255612 A1 10/2013 Zurface et al.
2013/0306013 A1 11/2013 Zurface et al.
2013/0312506 A1 11/2013 Nielsen et al.
2013/0312681 A1 11/2013 Schultheis et al.
2013/0312686 A1 11/2013 Zurface et al.
2013/0312687 A1 11/2013 Zurface et al.
2013/0312688 A1 11/2013 VanDeusen
2013/0312689 A1 11/2013 Zurface et al.
2014/0041608 A1 2/2014 Zurface
2014/0150745 A1 6/2014 Church
2014/0190431 A1 7/2014 McCarthy, Jr.
2014/0283768 A1 9/2014 Keller et al.
2015/0128890 A1 5/2015 Cecur
2015/0211394 A1 7/2015 Zurface et al.
2015/0267574 A1 9/2015 Radulescu et al.
2015/0369095 A1 12/2015 Spoor et al.
2015/0371793 A1 12/2015 Sheren et al.
2015/0377093 A1 12/2015 Church
2016/0061067 A1 3/2016 Schultheis et al.
2016/0061068 A1 3/2016 Zurface
2016/0084117 A1 3/2016 Zurface et al.
2016/0108766 A1 4/2016 Zurface et al.
2016/0115831 A1 4/2016 Spoor et al.
2016/0130991 A1 5/2016 Zurface et al.
2016/0138435 A1 5/2016 Zurface et al.
2016/0138438 A1 5/2016 Genise et al.
2016/0138484 A1 5/2016 Nielsen et al.
2016/0146064 A1 5/2016 Spoor et al.
2016/0169065 A1 6/2016 VanDeusen

(56) References Cited

U.S. PATENT DOCUMENTS

| | | | |
|---|---|---|---|
| 2016/0230619 | A1 | 8/2016 | McCarthy, Jr. |
| 2016/0273413 | A1 | 9/2016 | Sheren et al. |
| 2017/0002698 | A1 | 1/2017 | Cecur |
| 2017/0248073 | A1 | 8/2017 | McCarthy, Jr. |
| 2018/0320603 | A1 | 11/2018 | Vance et al. |
| 2019/0284971 | A1 | 9/2019 | Vance et al. |
| 2019/0309659 | A1 | 10/2019 | Vance |
| 2020/0056512 | A1 | 2/2020 | Vance |

FOREIGN PATENT DOCUMENTS

| | | | |
|---|---|---|---|
| WO | WO 2014134601 | A1 | 9/2014 |
| WO | WO 2014134601 | A9 | 9/2014 |
| WO | WO 2016155978 | A1 | 10/2016 |
| WO | 2017024249 | A1 | 2/2017 |
| WO | 2018068043 | A1 | 4/2018 |
| WO | 2018068045 | A1 | 4/2018 |
| WO | 2018068046 | A1 | 4/2018 |

OTHER PUBLICATIONS

Written Opinion for PCT/US2017/055788 dated Jan. 24, 2018; pp. 1-13.
International Search Report for PCT/US2016/045842 dated Oct. 28, 2016; pp. 1-5.
Written Opinion for PCT/US2016/045842 dated Oct. 28, 2016 pp. 1-18.
International Search Report for PCT/US2017/055777 dated Jan. 24, 2018; pp. 1-4.
Written Opinion for PCT/US2017/055777 dated Jan. 24, 2018; pp. 1-19.
International Search Report for PCT/US2017/055766; dated Jan. 22, 2018; pp. 1-3.
Written Opinion for PCT/US2017/055766 dated Jan. 22, 2018; pp. 1-18.
International Search Report for PCT/US2017/055785 dated Jan. 17, 2018; pp. 1-7.
Written Opinion for PCT/US2017/055785 dated Jan. 17, 2018; pp. 1-11.

* cited by examiner

*FIG.1C* *(Prior Art)*

THREE ROLLER ROCKER ARM WITH CANTILEVERED ROLLERS AND LOST MOTION SPRING OVER VALVE OR OVER ROCKER ARM PIVOT

This is a § 371 National Stage Entry of Patent Cooperation Treaty Application No. PCT/US2017/055766, filed Oct. 9, 2017, and claims the benefit of U.S. provisional application Nos. 62/405,690, filed Oct. 7, 2016, 62/472,388 filed Mar. 16, 2017, 62/473,918 filed Mar. 20, 2017, 62/473,890 filed Mar. 20, 2017, 62/473,864 filed Mar. 20, 2017, 62/506,469 filed May 15, 2017, 62/549,471 filed Aug. 24, 2017, and 62/554,909 filed Sep. 6, 2017, all of which are incorporated herein by reference.

FIELD

This application provides a rocker arm for a valvetrain comprising three rollers, two of which are cantilevered, and a lost motion mechanism biased by at least one spring.

BACKGROUND

Biasing a rocker arm and its components against an affiliated actuator is difficult due to packaging constraints. And, tailoring a rocker arm for myriad possible lift profiles is difficult to design for, as the moving parts are prone to interfere with one another. In the prior art example of FIG. 1A, a through-axle 1 passes through rollers 2, outer arms 3, inner arms 4, and a roller axle 6. Roller axle 6 supports a roller 7. Springs bias the hollow roller axle 6 in one direction so that when a latch mechanism is latched, an exhaust valve can have the exhaust valve profile shown in FIG. 1B, or an intake valve can have the intake valve profile shown in FIG. 1C. When unlatched, the IEGR (internal exhaust gas recirculation) on exhaust valve profile can be achieved in FIG. 1B, or the late intake closing (LIVC) profile can be achieved in FIG. 1C. The motion differences between the latched and unlatched profiles are sufficient for some purposes, but the through-axle is restrictive for accomplishing other purposes.

SUMMARY

The methods and devices disclosed herein overcome the above disadvantages and improves the art by way of a rocker arm for a valve train comprising a main body comprising a pivot end, a valve end, a first outer side, and a second outer side. A first post is connected to the first outer side and extends away from the first outer side. A second post is connected to the second outer side and extends away from the second outer side oppositely from the first post. A latch mechanism is within the pivot end of the main body, the latch mechanism comprising a latch finger configured to selectively move between a latched position, wherein the latch finger extends towards the valve end, and an unlatched position, wherein the latch finger withdraws away from the valve end, the latch comprising a latch surface. An inner arm assembly pivots from the valve end between the first outer side and the second outer side. The inner arm assembly comprises a latch arm pivotable from a position above the latch surface to a position below the latch finger. A first roller is connected to rotate on the first post. A second roller is connected to rotate on the second post. At least one biasing mechanism biases the latch arm towards the position above the latch surface.

Alternatively, a rocker arm, comprises a first outer arm comprising a first inner side and a first outer side, the first outer side comprising a first cantilevered post. A first outer roller is mounted to the first cantilevered post. A second outer arm comprises a second inner side and a second outer side, the second inner side facing the first inner side, the second outer side comprising a second cantilevered post. A second outer roller is mounted to the second cantilevered post. A pivot body joins the first inner side to the second inner side. An actuatable latch mechanism is within the pivot body. An inner arm assembly comprises a latch arm, the latch arm pivotable adjacent the pivot body. A pivot axle joins the inner arm assembly to pivot between the first outer arm and the second outer arm.

A valvetrain can comprise a rocker arm. The valvetrain can further comprise a set of three rotating cam lobes respectively configured to press upon each of the first roller, the second roller, and the inner roller, wherein the at least one biasing mechanism biases the inner roller towards the set of rotating cam lobes.

A valvetrain can comprise a rocker arm. The valvetrain can further comprise first, second, and third rotating cam lobes respectively configured to press upon each of the first roller, the second roller, and the inner roller, wherein the third rotating cam lobe is configured to selectively push the latch arm to rotate past the latch finger when the latch finger is in the unlatched position.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

BRIEF DESCRIPTION OF THE DRAWINGS

FIGS. 1B & 1C are views of prior art valve lift profiles for the through-axle rocker arm.

DETAILED DESCRIPTION

Reference will now be made in detail to the examples which are illustrated in the accompanying drawings. Wherever possible, the same reference numbers will be used throughout the drawings to refer to the same or like parts.

Figure 1A:
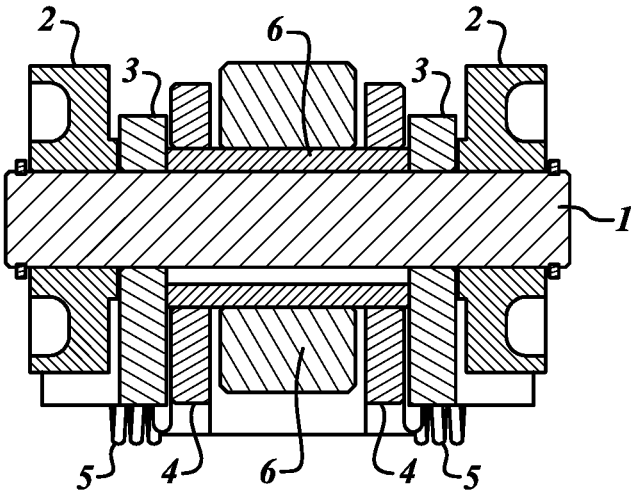
FIG.1A (Prior Art)
FIG. 1A is a cross-section view of a prior art through-axle rocker arm.
Figure 1B:
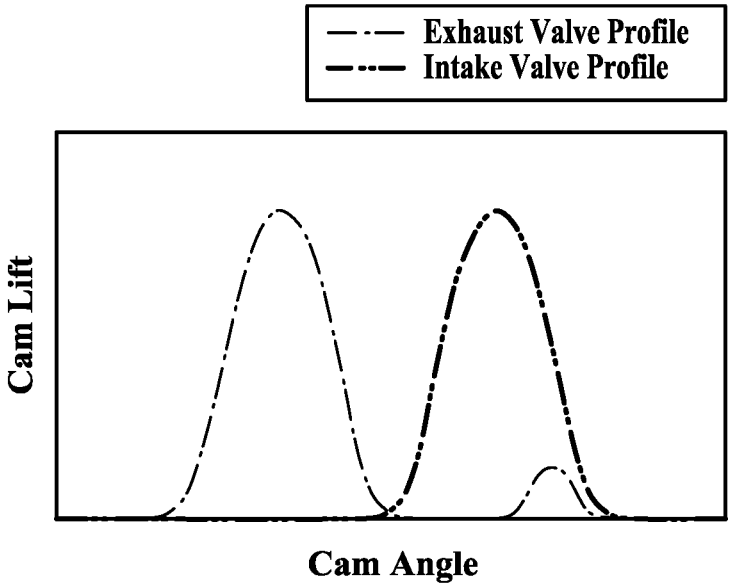
FIG.1B (Prior Art)

Rocker arms are subject to high actuation rates during valve lift and lowering. It is desired to provide increased lost motion and to enable early intake valve closing and other variable valve actuation, such as cylinder deactivation. However, prior art switching rolling finger follower (SRFF) designs are constrained to low lift events or high loss events, but cannot provide a range of lift events. FIG. 1A shows a prior art SRFF with limited range on the variable valve lift (VVL) events, corresponding to US 2015/0128890. A regular exhaust valve profile and a regular intake valve profile can be achieved utilizing the SRFF of FIG. 1A. Using a latch, the SRFF can be switched to provide internal exhaust gas recirculation (IEGR) as in FIG. 1B or late intake valve closing (LIVC) profile as in FIG. 1C. But in FIG. 1A, a center through-axle 1 restricts the motion of the example SRFF. By eliminating the through-axle 1, a greater range of motion can be achieved.

Figure 2A:
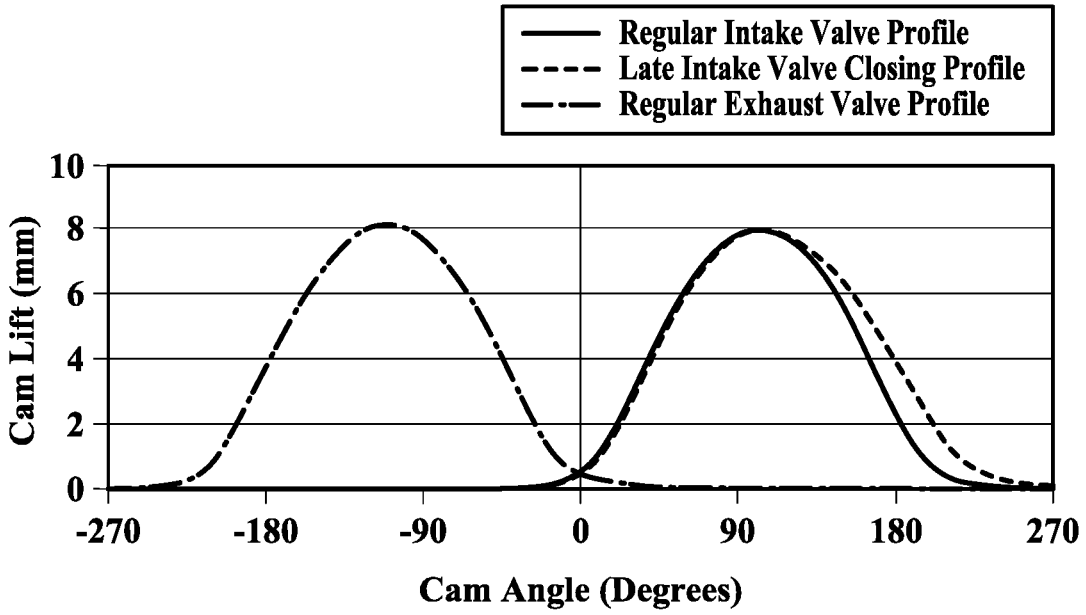
FIGS. 2A & 2B are views of valve lift profiles that can be achieved in addition to the prior art valve lift profiles when using the instant disclosure.
Figure 2A:
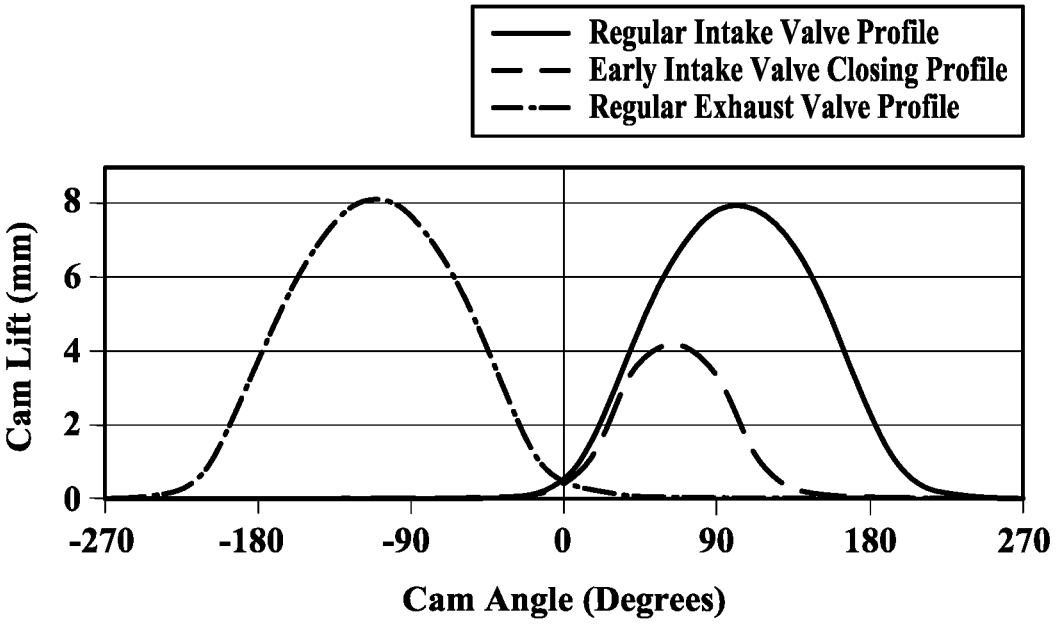

For example, the early intake valve closing (EIVC) profile of FIG. 2A can be achieved utilizing the SRFFs disclosed herein. Three eccentric cam lobes, two outer lobes 1001 & 1002 and an inner lobe 1003, can rotate on a cam rail 1000 of a type II engine valvetrain. Actuators for the SRFF can comprise electro-mechanical latches or cam lobes. The rocker arm can be mounted in a type II overhead cam valvetrain having one or more cam rails. Or, other actuation rails can be implemented for a cam/camless system having some cam operations and some operations without cams. Each roller 400, 410, 310 of the rocker arm (SRFF) can correspond to a cam lobe or other actuator.

Figure 12A:
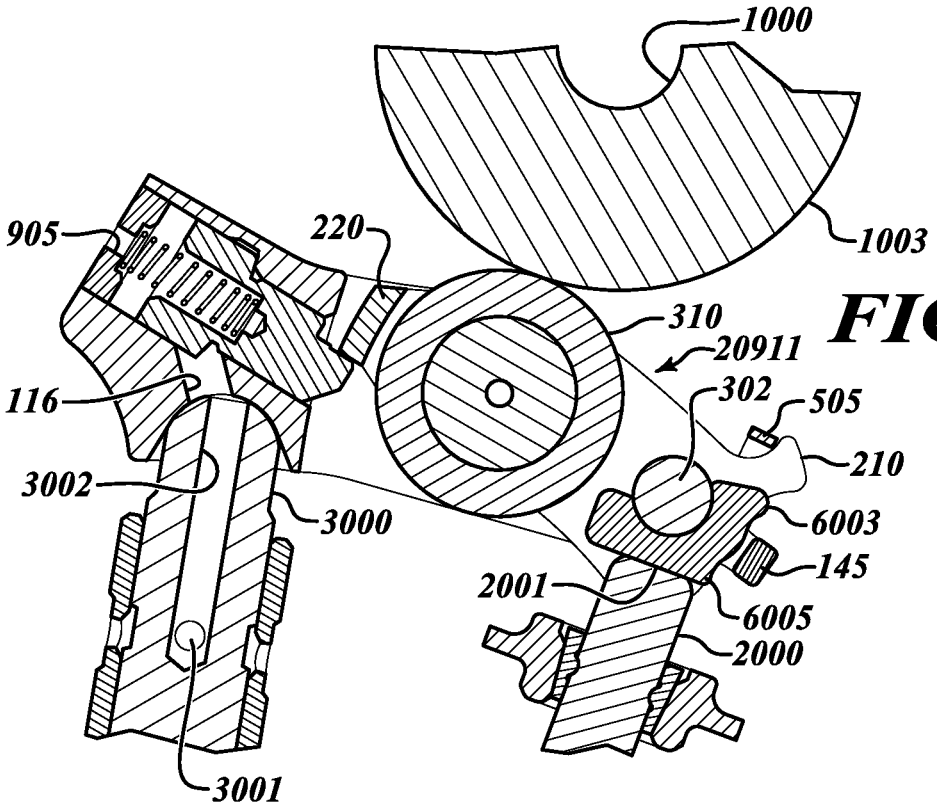
FIGS. 12A & 12B contrast a rocker arm in a valvetrain at base circle and at full actuation of the inner arm assembly.

The shapes of the cam lobes 1001, 1002, 1003 determine the motion of the SRFF as a latch mechanism 900 within the pivot body 111 is selectively actuated. As seen in FIG. 12A, a rocker arm latched while the cam 1003 is at base circle can result in a valve being closed. But, controlling hydraulic fluid through a hydraulic lash adjuster (HLA) 3000, as via fluid ports 3001, 3002 can actuate latch mechanism 900, retract latch finger 906, and permit inner arm assembly 20911 to swing down when the peak of the eccentric portion of the cam lobe 1003 presses against roller 310. HLA or like mechanism can connect the SRFF to an engine block on the pivot end 11 of the SRFF. Additionally or alternatively, a push rod can be coupled to the HLA 3000. A valve end 12 of the SRFF can comprise a valve seat in the form of a valve pallet 112, or one of the alternatives herein or the like, for mounting a valve stem end 2001 of a valve so that the valve head 2003 can be opened and closed to provide the desired valve profile. For example, when the SRFF is latched, a high lift profile, shown in FIG. 2B, can be achieved. The inner cam lobe 1003 can be designed with a larger cam lift (in millimeters) than the outer lobes 1001, 1002. The eccentricity of the lobes can be designed so that as the cam lobes rotate (shown as cam angle in degrees) off their base circle, the valve head 2003 can open and close with one or more of different timing, duration and extent. So in FIG. 2B, the outer lobes 1001, 1002 are designed with a smaller cam lift than the inner lobe 1003. With the SRFF unlatched, the inner lobe 1003 pushes on the inner roller 310 linked to inner arms 200, 210 and the outer lobes 1001, 1002 push on the outer rollers 400, 410 to result in a low lift profile. A delta profile shows the difference between the high and low lift profiles. The height of the delta profile can be correlated to the relative motion of the inner arm of the SRFF and can indicate the lost motion travel of the inner arm. The lift events can be significantly higher for the high lift event than for prior work. Approximately 30% more lift can be achieved using the disclosed arrangements. And, the same SRFF can be used to achieve the lift profiles of the prior art devices, such as FIGS. 1B & 1C, as by pairing the disclosed SRFFs with appropriate cam lobe pairings.

Figure 2B:
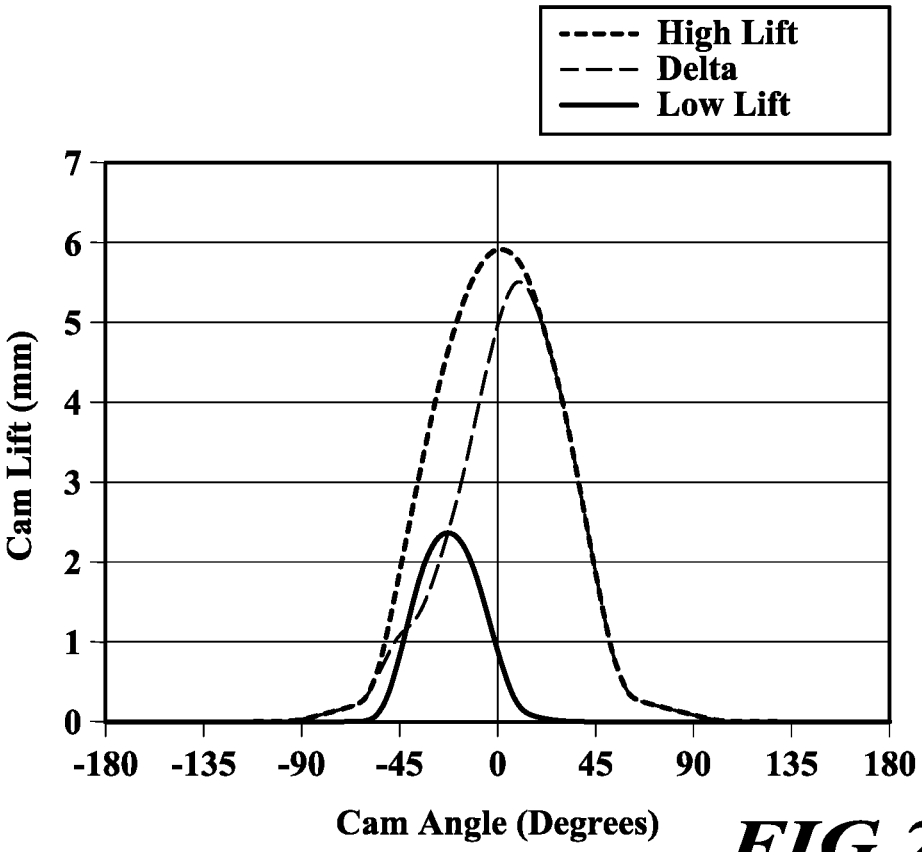
Figure 3:
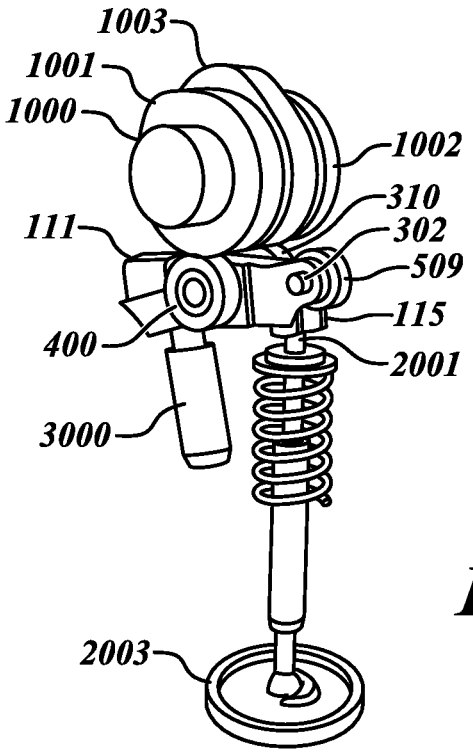
FIG. 3 shows a portion of a valve actuation system.

FIGS. 2A & 2B are example lift profiles. Other lift profiles are possible and have not been drawn exhaustively. The rocker arm can comprise three rollers 400, 410, 310. Two outer rollers 400, 410 are mounted in a cantilever fashion outboard on the rocker arm to rotate on posts 123, 133 on the outer arms.

The third roller (inner roller) 310 can be mounted on an independent bearing axle, such as second axle 300, between the inner arms 220, 230. The inner arms 220, 230 can pivot on a pivot axle, such as first axle 302. The pivot axle can connect the inner arm assembly 209 to distal ends of the outer arms 120, 130. First axle 302, as pivot axle, can also connect the at least one biasing mechanism, center spring 509, to the rocker arm.

When the inner arm assembly 209 pivots on the pivot axle, "lost motion" is said to occur, and the inner arms 200, 210 can pivot to permit variable valve lift events from zero valve lift (full cylinder deactivation, or full lift loss) through to some amount less than full lift. Alternatively, the inner arms can be latched via a latch seat to permit a high lift event, greater than a normal lift event, while a normal lift event takes place on the rollers of the outer arms.

This enables techniques such as cylinder deactivation (CDA) (valve closure) and early or late valve techniques, including negative valve overlap (NVO), early or late intake valve opening or closing (EIVC, LIVC, EIVO, LIVO), or early or late exhaust valve opening or closing (EEVO, EEVC, LEVO, LEVC).

So, it is possible to design the SRFF, sometimes called a rocker arm, for either variable valve lift events or for cylinder deactivation (CDA). In a first engine operating mode, inner cam lobe 1003 presses on an inner roller 310 housed between inner arms 200, 210 of the rocker arm. A latch is biased or actuated to catch against a latch seat linked to the inner arms so that the cam lob pushes both inner arms 200, 210 and outer arms 120, 130 of a main body 110 of the rocker arm. This yields a first lift height for an affiliated valve. Then, during a second engine operating mode, the latch can be moved away from the latch seat to allow the inner arms 200, 210 to pivot when the inner cam lobe 1003 presses on the inner roller 310. The lift height of the inner cam lobe can be "lost," because it is not transferred to the valve. Outer cam lobes 1001, 1002 can press on the outer arms 120, 130 of the rocker arm to accomplish a second lift height. The second lift height can be from zero to some amount less than the first lift height.

Turning to the first exemplary SRFF in FIGS. 4A-4G, there is no longer a through-axle 1 spanning through three rollers 2, 7. The middle, or inner roller 310, can now be a single shear material, instead of a dual layer material. The sleeved design on the inner roller of FIG. 1A can be eliminated. The outer rollers 400, 410 are cantilevered from the SRFF main body, and instead of sliding the through axle 1 through the outer arms, as in FIG. 1A, the outer rollers 400, 410 can be mounted on cantilevered posts 123, 133 that are integrally formed with the outer arms 120, 130. By using rollers 400, 410, 310 instead of slider pads, there are less friction losses. By cantilevering the outer rollers 400, 410 to the SRFF main body, large lift events can be accommodated. An inner arm assembly 209 can move independently of the outer arms 120, 130. The inner arm assembly 209 can comprise inner arms 200, 210, latch arm 220, and an inner roller 310, among additional features and alternatives outlined below.

FIGS. 4A-4G show alternative views of an SRFF having a lost motion spring 509 over the valve end of the main body 110 and cantilevered outer rollers 400, 410. The latch mechanism 900 for the center lost motion mechanism is in-line with the main profile of the SRFF. The in-line shape can be understood by looking at the planar cross-section of FIG. 4D, where the in-line shape is the result of a co-planar relationship of the first axle 302 (pivot axle) that joins the inner arms 220, 230 to the outer arms 120, 130, the bearing (or second) axle 300, and the main axis of the latch mechanism 900.

The center spring 509 is over the valve end of the rocker arm. A valve stem end 2001 can be mounted to abut second side 114 of valve pallet 112. Valve guides 115 can be formed on the valve pallet 112 in the form of projections that guide the valve stem end 2001 as the SRFF rocks during actuation. The valve guides can be hooked or cleated to retain the valve stem end 2001. The valve guides 115 limit the ability of the valve stem end 2001 to move from side to side against the valve pallet 112, while not restricting the ability of the valve stem end to slide front to back along the valve pallet second side 114. That is, the valve stem 2000 can move slightly in directions parallel to the long axis A-A of the SRFF, but is restricted from moving perpendicular to the long axis of the SRFF. Meanwhile, an hydraulic lash adjuster (HLA) 3000 can be mounted in a ball-and-socket type arrangement in HLA seat 117 to cooperate with hydraulic port 116.

The center spring can be biased in several ways. For example, a first end 5001 of the center spring 509 can be biased against a spring prop in the form of an inner bar 204. A second end 5002 of the center spring 509 can be biased against first side 113 of valve pallet 112. Alternative biasing techniques will be discussed below.

The latch mechanism 900 is in a latched position in FIGS. 4A-4D. The center spring biases the inner arm assembly 209 so that inner roller 310 is lifted towards the inner cam lobe 1003 when the SRFF is installed in a valve train. This can also mean that the latch arm 220 is biased to a position above a surface of latch assembly 900, such as above latch seat 901. So, the latch arm 220 of the inner arm 200 can be in contact with the latch seat 901 when the inner arm assembly 209 is pressed from above, or the latch arm 220 it can be biased to a position slightly above the latch seat 901.

Figure 4A:
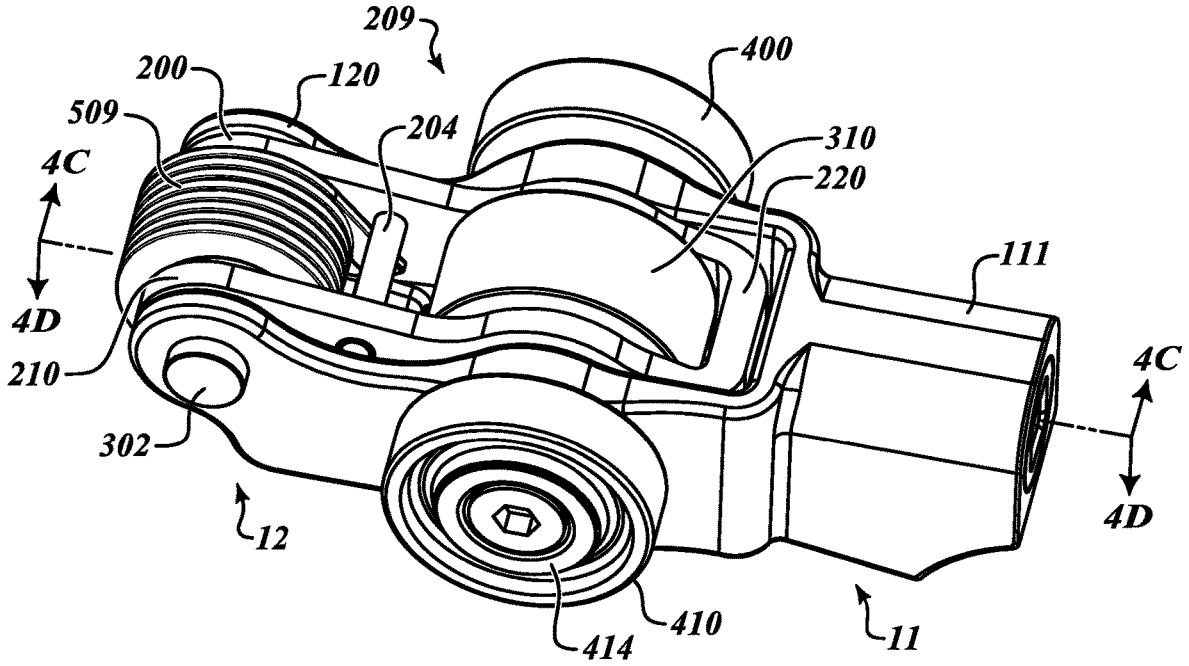
FIGS. 4A-4G show alternative rocker arm views comprising an inner spring.
Figure 4B:
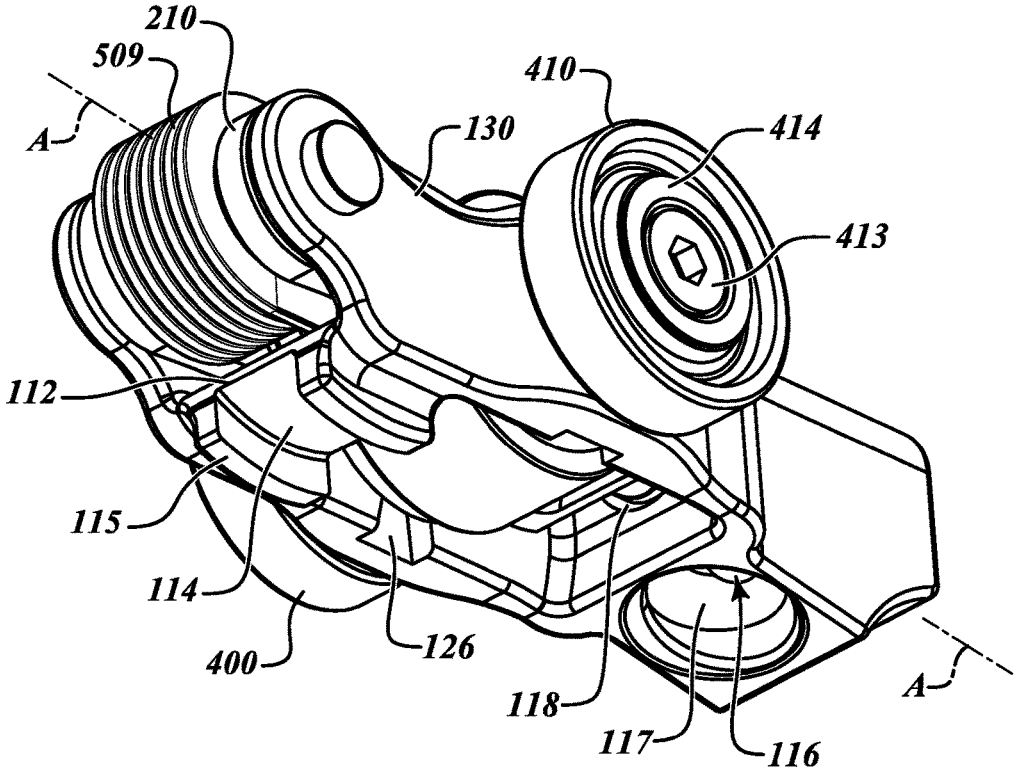
Figure 4C:
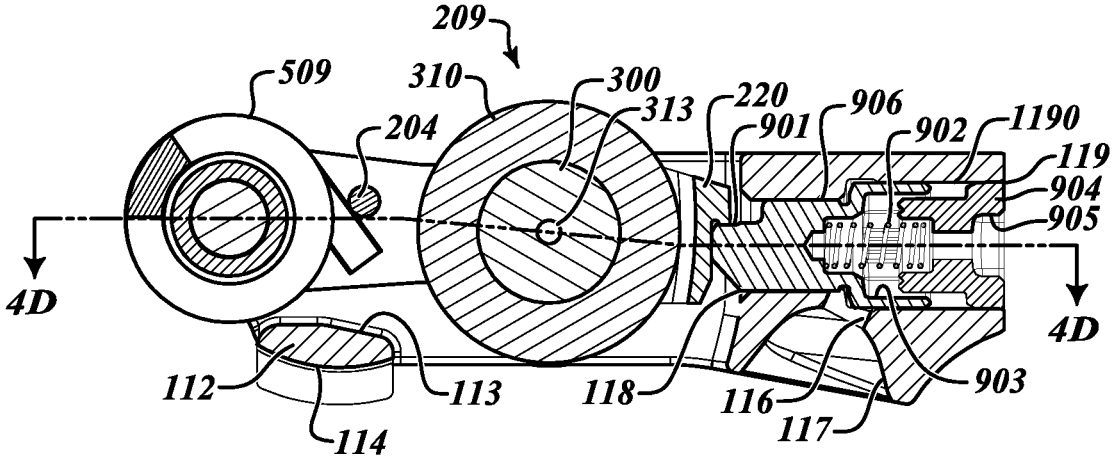
Figure 4D:
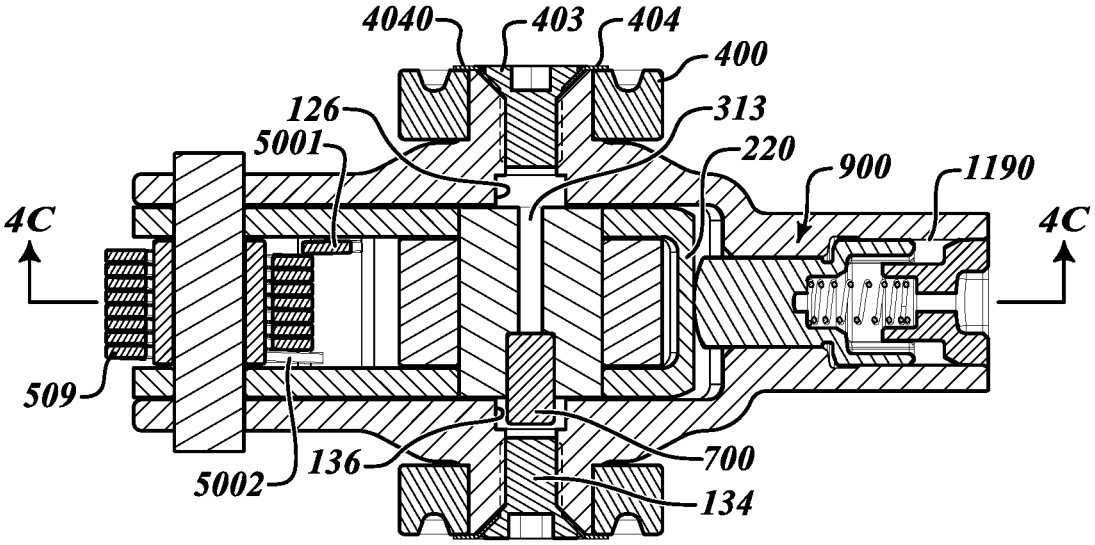
Figure 4E:
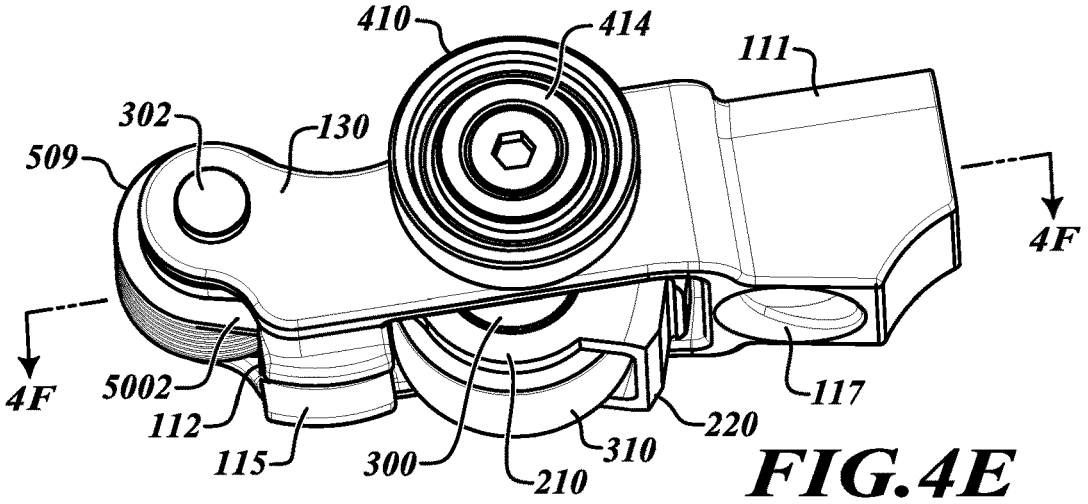
Figure 4F:
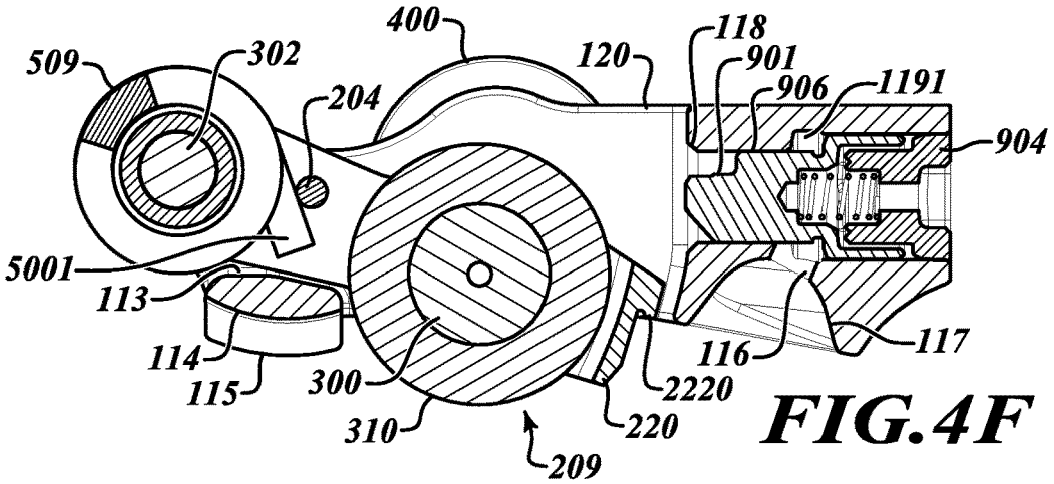

In FIGS. 4E & 4F, the latch mechanism 900 is in an unlatched position and latch arm 220 has rotated past the latch to "lose" the motion of the center cam lobe 1003 on the inner arm assembly 209. Outer cam lobes 1001, 1002 can roll on the outer first and second rollers 400, 410.

The latch mechanism 900 can be actuated by hydraulics, and thus be connected to oil control valves and an oil control circuit. Or, electric or electro-mechanical mechanisms can reciprocate a latch. The latch can be biased to operate in a default position or require affirmative control for each of the first or second positions (extended or withdrawn positions).

In the example of FIGS. 4A-4F, a hydraulic latch is shown for the latch mechanism 900. A latch finger 906 can reciprocate so that a latch seat 901 can extend from and retract in to an inner latch port 118 in the pivot body 111 of the SRFF. The latch finger 906 can fluidly communicate with hydraulic port 116 so that fluid can be fed through the HLA 3000 or through a latch fluid port 905, or a fluid circuit can be established therethrough. Latch port 118 in stepped, as is the latch finger 906 so that a shoulder can fill a portion 1190 of latch cavity when the latch finger 906 is extended, and the shoulder can fill another portion 1191 of latch cavity with latch finger 906 is retracted. Latch plug 904 can receive and bias a latch spring 902 that can bias the latch finger 906 to the extended position. As above, other latch mechanisms can be substituted for the hydraulic latch illustrated without departing from the SRFF operation principles described herein.

FIGS. 4C & 4D illustrate additional aspects. The inner roller 310 can be a unitary material, or it can comprise a separate bearing axle or second axle 300 fixed across the inner arms 220, 230 and an outer material, as illustrated. In some embodiments, the bearing axle 300 can be surrounded by bearings, such as ball or needle bearings 312, and the outer material serves as an outer race and a bearing surface for interfacing with cam lobe 1003. Either way, a hollow passageway 313 can be formed within the inner roller 310. The hollow passageway can permit lightweighting or other weight control techniques. When combined with below aspects, the hollow passageway can be used with an alignment tool to set the placement of a pump-down stop, such as pin 700.

FIGS. 4E & 4F illustrate the SRFF in an unlatched condition. The latch finger 906 is in a retracted position, and a shoulder of the latch finger is withdrawn to permit fluid in the other cavity 1191 of the stepped inner latch port 118. As above, the central spring 509 is biased between spring prop 204 and first side of valve pallet 113. But, an inner cam lobe 1003 can overcome the spring force of central spring 509. Latch arm 220 can swing past the latch mechanism 900 as inner arm assembly 209 pivots on first axle 302, but the inner arms 200, 210 cannot swing past valve pallet 112. because the inner arms can come in to contact with the first side 113 of the valve pallet 112. So, the extent of inner arm assembly 209 travel can be restricted by a pump-down stop, such as pins 700, 701, 703, in a first direction and the valve pallet 112 in a second direction.

While the example of FIGS. 4A-4G show an in-line latch, other examples show an alternative design having an angled latch mechanism 900 for the center lost motion mechanism (inner arm assembly 209). The angled latch can comprise the pivot axle (first axle 302) and the inner arm first axle 300 in-line in a plane (intersected by a plane), and the latch mechanism 900 can be angled away from the plane (the latch mechanism 900 can be in an intersecting plane). In FIGS. 4A-4G, the lost motion spring is inside the main body of the SRFF, and the lost motion spring biases the inner roller 310 towards the cam rail 1000. The lost motion spring 509 is positioned over the valve. But in the other examples, the lost motion spring, or springs, are in different locations, but continue to bias the inner roller 310 towards the cam rail 1000 or towards a position above the latch finger 906.

Pivot-Side Lost Motion Springs

In FIGS. 6A-6E, another alternative is shown with the lost motion springs over the pivot end 11 of the SRFF. Inner arm assembly 2096 can comprise inner arms 200, 210, latch arm 220, and inner roller 310. Inner roller can be between inner arms 200, 210 and can comprise a portion of the bearing axle 300 extending out through the inner arms 200, 210 towards the outer arms 120, 130. The lost motion springs are over the hydraulic lash adjuster (HLA) 3000 or pushrod and is not over the valve end 12 in this embodiment. So, there is less weight over the valve, which increases beneficial valvetrain dynamics. The valve operation is more optimal. Also, instead of a single lost motion spring in the center of the SRFF, two lost motion springs flank the latch mechanism 900.

The lost motion springs are pivot side springs 5010, 5020 mounted to spring posts 1131, 1141 on pivot body 111 on the pivot end of the rocker arm. A spring bushing 5040 can be pressed to each spring post 1131, 1141 to secure pivot side springs 5010, 5020 in place. Main body 110 can comprise first and second ledges, such as pivot ledges 1111, 1121, for biasing first spring arm ends 5011, 5013. Second spring arm ends 5021, 5023 can be biased against bearing axle 300 (which can be integrally formed with inner roller 310). Bearing axle 300 can extend out from inner arms 220, 230 to catch against the second spring arm ends 5021, 5023.

The arrangement permits straight arms on the spring for the spring arm ends 5011, 5013, 5021, 5023. Also, the "kidney bin" of prior designs, where the bearing axle previously passed through the outer arms and restricted the extent of inner arm travel, is eliminated. Outer arm can comprise bends 1201, 1301 in the outer arms 120, 130 while the inner arms 210, 220 are straight. Additional alternatives can be understood viewing the pump-down stops, and the arrangement of FIGS. 6A-6E can comprise the pin 700, 701, 703 arrangements of FIGS. 4G & 5A-5E with provisions for catching the second spring arm ends 5021, 5023.

With the lost motion springs on the pivot end of the SRFF, the inertia is reduced over the valve, and valve actuation can be quicker. Additional lightweighting on the valve side can inure from removing spring prop 204.

Figure 6A:
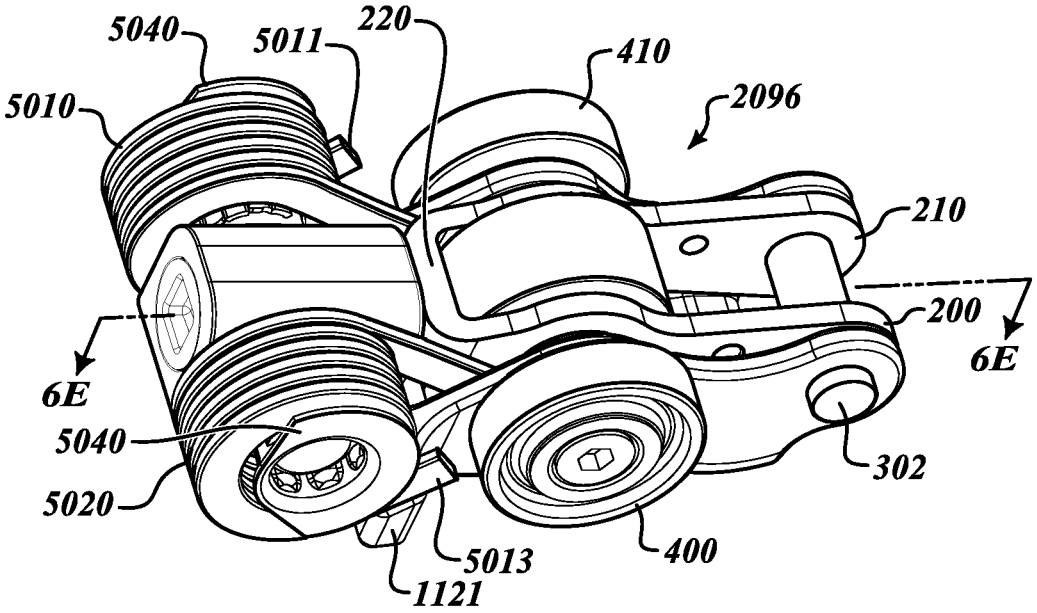
FIGS. 6A-6E show alternative rocker arm views comprising springs on the pivot end.
Figure 6B:
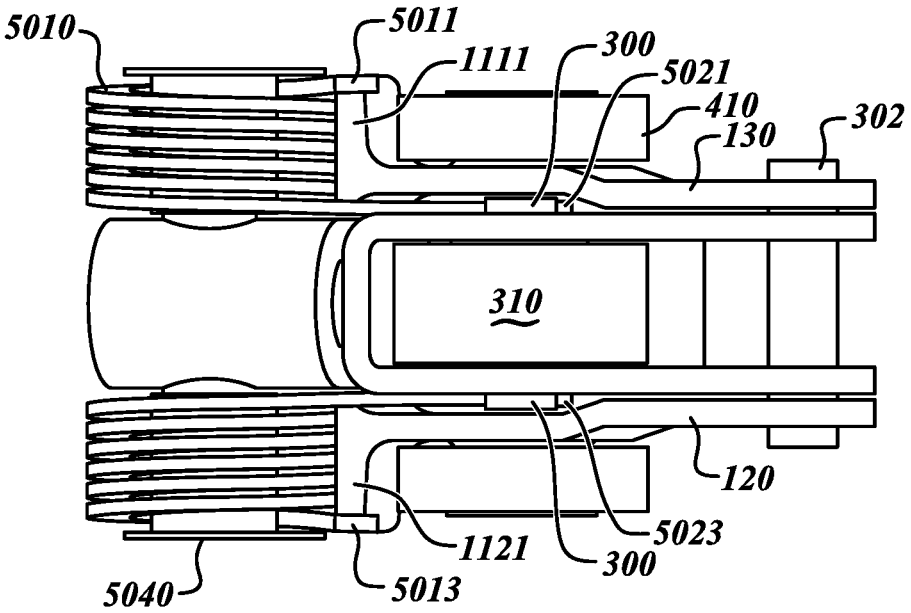
Figure 6C:
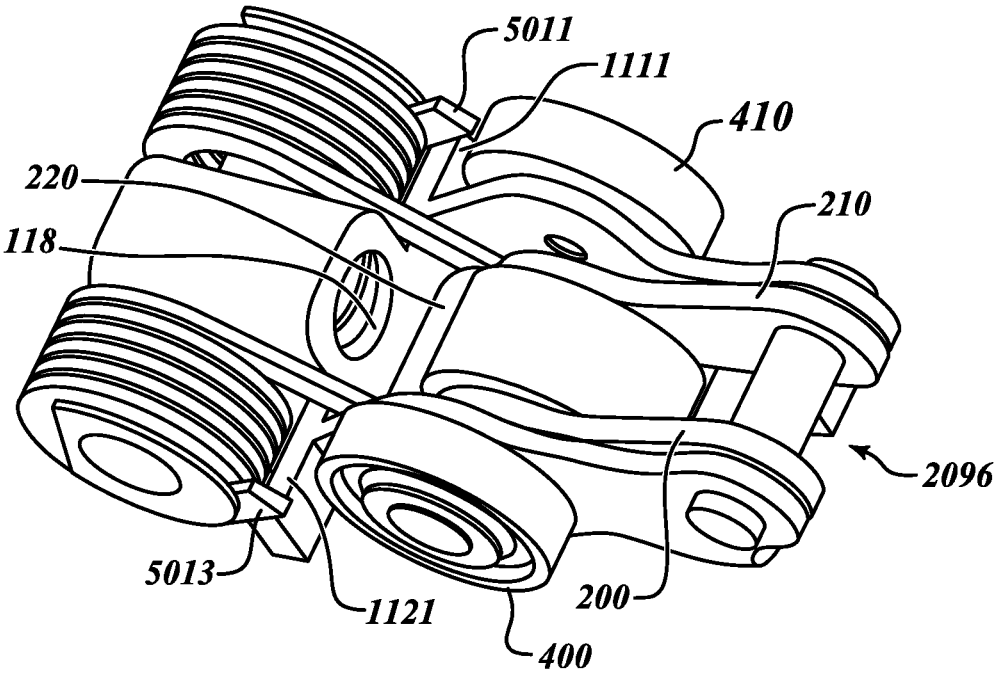
Figure 6D:
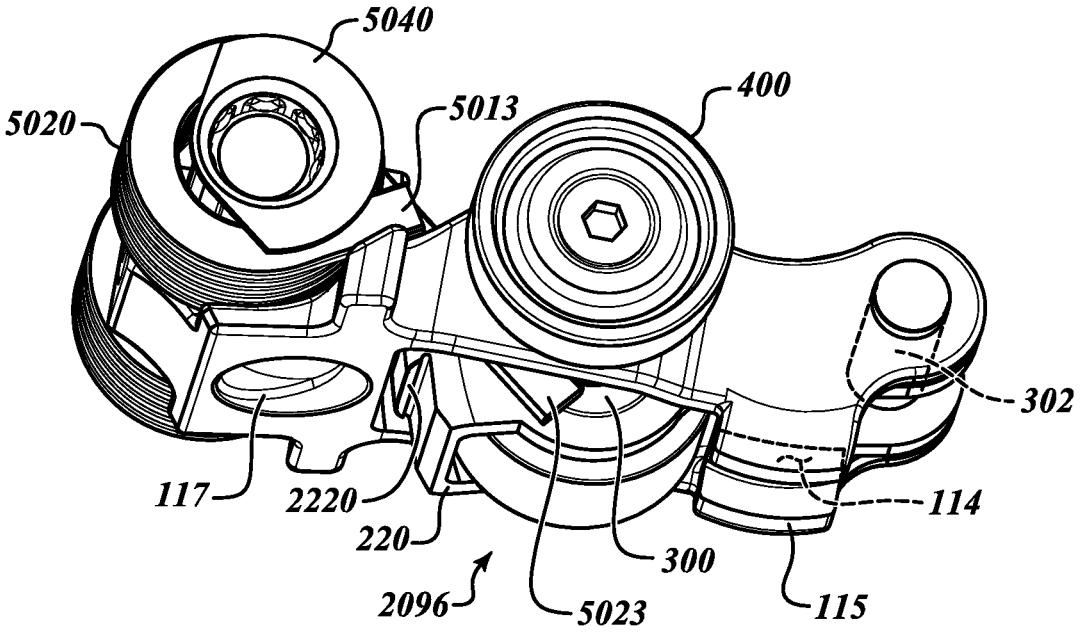
Figure 6E:
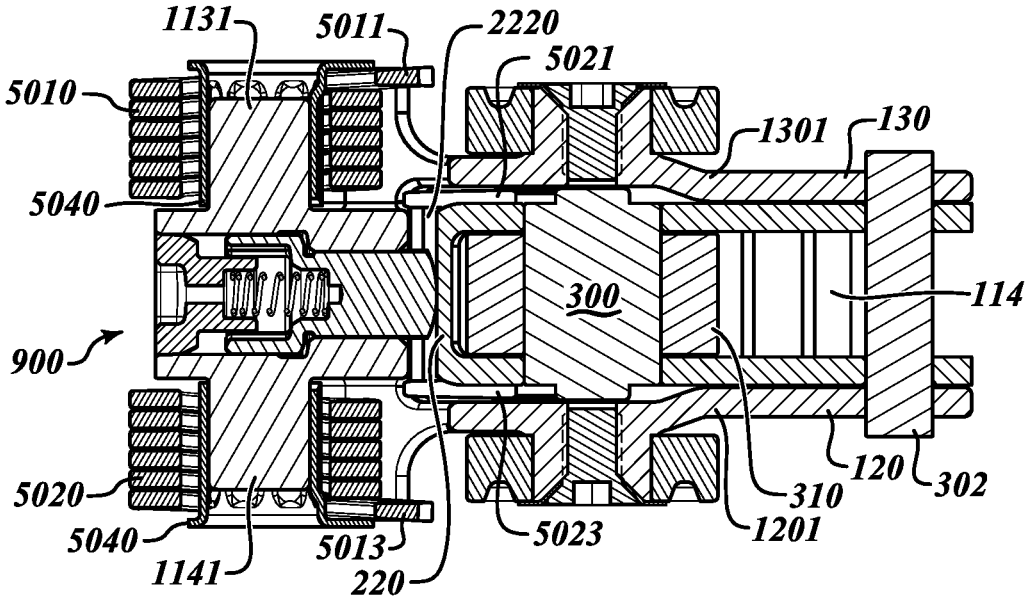

In FIGS. 6A, 6B, & 6E, the rocker arm is shown in a latched position, while FIGS. 6C & 6D show the inner arm pivoted away from the latch mechanism while in the unlatched position. The travel of the inner arm assembly 209 can be limited as by one of travel limit techniques herein, such as the pump-down stop techniques below or such as being restricted by the valve pallet 112, as above.

Also, the spring-over-pivot side configuration of FIGS. 6A-6E can be in-line, as in FIG. 6E, such that a plane can intersect each of the first axle (pivot axle) 302, the bearing axle 300, and the long axis of the latch mechanism 900. Or, an angled-latch configuration can be used, such that a first plane can intersect each of the first axle (pivot axle) 302 and the bearing axle (second axle) 300 while the long axis of the latch mechanism 900 is in a separate plane that intersects the first plane.

A rocker arm for a valve train can thus comprise a main body 110 comprising a pivot end 11 and a valve end 12. Outboard sides 121, 131 can constitute a first side and a second side. A first post 123 can be connected to the first side 121 as by being integrally formed with the first side, and the first post 123 can extend away from the first side 121. A second post 133 can be connected to the second side and can extend away from the second side oppositely from the first post 123. First roller 400 can be connected to rotate on the first post 123 and second roller 410 can be connected to rotate on the second post 133. First and second posts 123, 133 can be cantilevered from the outboard sides 121, 131.

A latch mechanism 900 can be within the pivot end 11 of the main body 110. Latch mechanism 900 can comprise a latch finger 906 configured to selectively move between a latched position, wherein the latch finger 906 extends towards the valve end 12, and an unlatched position, wherein the latch finger 906 withdraws away from the valve end 12. The latch finger 906 can comprise a latch surface 901.

Latch arm 220 of inner arm assembly 209 can pivot from the valve end 12 between the first side and the second side from a position above the latch surface 901 to a position below the latch surface 901. Inner arm assembly 209 can comprise an axle 300 and a third roller, inner roller 310, rotatable on the axle 300. Latch arm 209 can be configured to latch against the latch surface 901 when the latch finger 906 is in the latched position and configured to rotate past the latch surface 901 when the latch finger 906 is in the unlatched position.

Additional alternatives exist for biasing the latch arm of the inner arm to a position above the latch seat 901 of the latch finger 906. Biased in this direction, the inner roller 310 can follow the cam lobe 1003 for actuation in a valvetrain.

Outboard Lost Motion Springs

Turning to FIGS. 7A-9B, alternative out-board spring designs are proposed, where the springs are mounted on the valve end 12 of the rocker arm. By switching from the inner coil spring 509 to the out-board alternatives, the springs 506, 507, 5060, 5070 can be mounted outboard on the rocker arm to avoid interference with the sweep of the inner cam lobe 1003.

In FIGS. 7A-7F, alternative one-piece torsion springs are shown. Ends of the alternative springs react against the out-board sides 121, 131 of the outer arms 120, 130, and the alternative springs also react against extensions on the inner arms 200, 210. In FIGS. 8A-9B, two springs 5060, 5070 are used with alternative arrangements for ends reacting against the outer (outboard) sides 121, 131 of the outer arms and for reacting ends against alternative extensions on the inner arms.

The rocker arm can comprise a first spring ledge 129 and a second spring ledge 139. Ledges 129, 139 can be longitudinally positioned between the pivot axle 302 and the first (inner) roller 310 or outer rollers 400, 410. The spring 500 can be mounted on the first axle 302. The spring 500 can be biased against the ledges 129, 139. The one-piece spring 500 of FIGS. 7A-7F can comprise a first spring 506 mounted on the first outer side 121 and a second spring 507 mounted on the second outer side 131. The first spring 506 and second spring 507 can be torsion springs with tangential spring ends extending at approximately 90 degrees. A lateral connector 505 can connect the first spring 506 to the second spring 507. The first spring 506, the second spring 507, and the lateral connector 505 can be integrally formed to make the one-piece spring 500. First spring 506 can comprise a ledge end 501 abutting the ledge 129, and the second spring 507 can comprise a ledge end 502 abutting ledge 139.

Lateral connector 505 can react against (be biased by) extensions on the inner arms 200, 210, such as respective hooked spring props 201, 211. A first spring prop 201 on the first inner arm 200 is distal from the latch arm 220. A second spring prop 211 on the second inner arm 210 distal from the latch arm 220. When cam lobe 1003 pivots the inner arm assembly 209, the lateral connector 505 is pressed by the spring props 201, 211 and the force is transferred into the coils of springs 506, 507. The inner arm assembly 209 can swing to permit lost motion, as in FIG. 7E. With the valve pallet 12 removed, the amount of lost motion possible with the SRFFs of FIGS. 7A-7F is greater than the prior embodiment. Also, the stresses of contacting the valve pallet 112 is removed from the SRFF and valvetrain system.

Figure 7A:
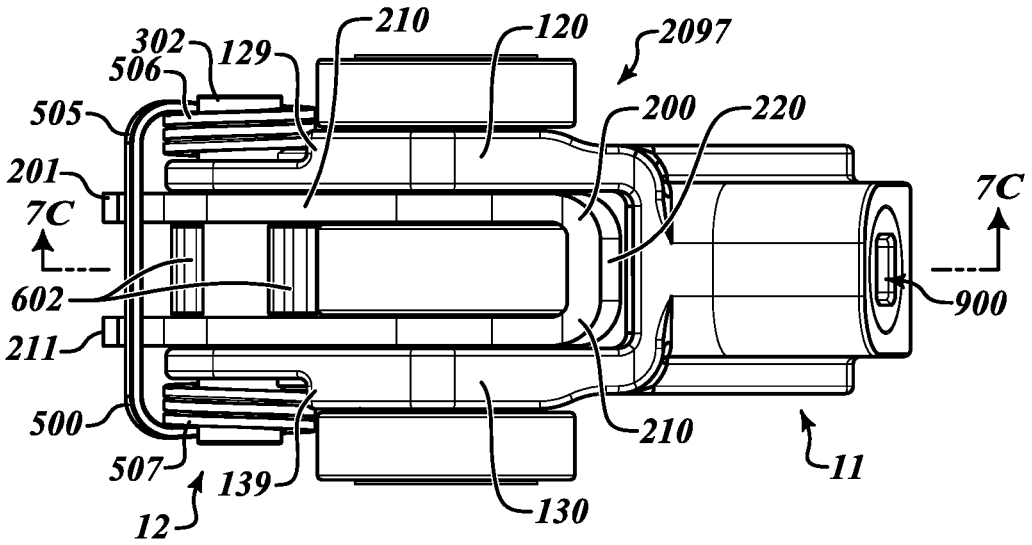
FIGS. 7A-7F show alternative rocker arm views comprising outboard springs on the valve end.
Figure 7B:
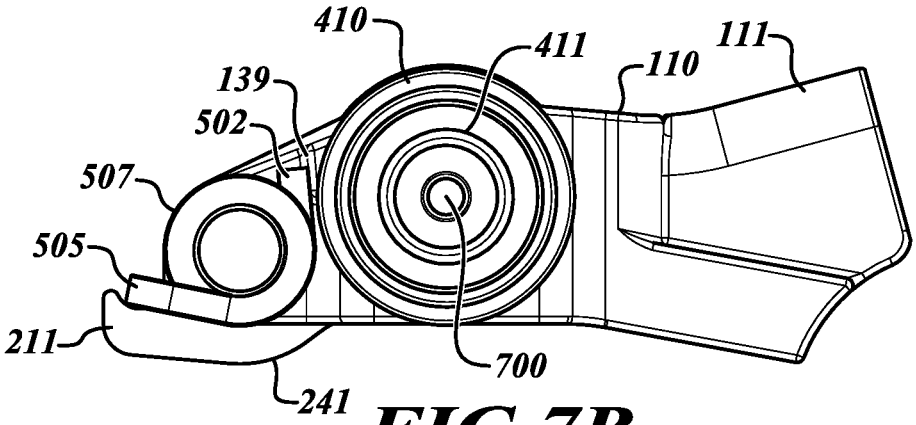
Figure 7C:
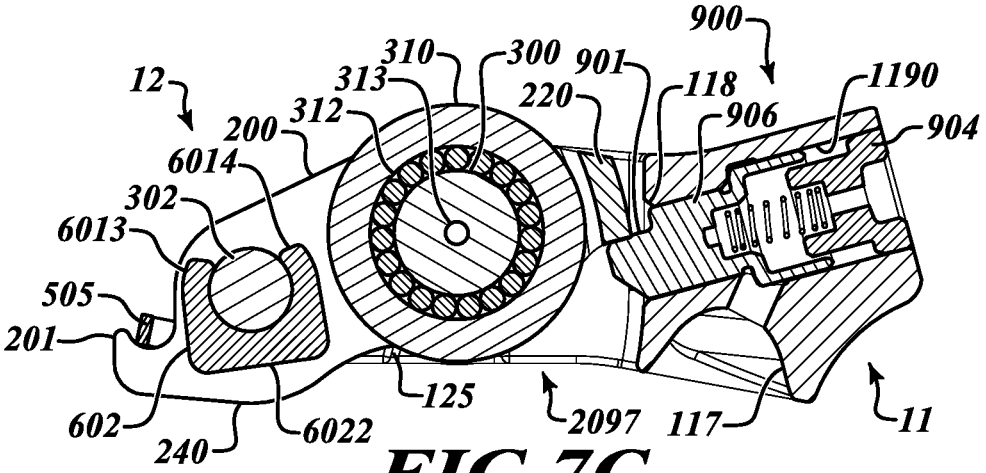
Figure 7D:
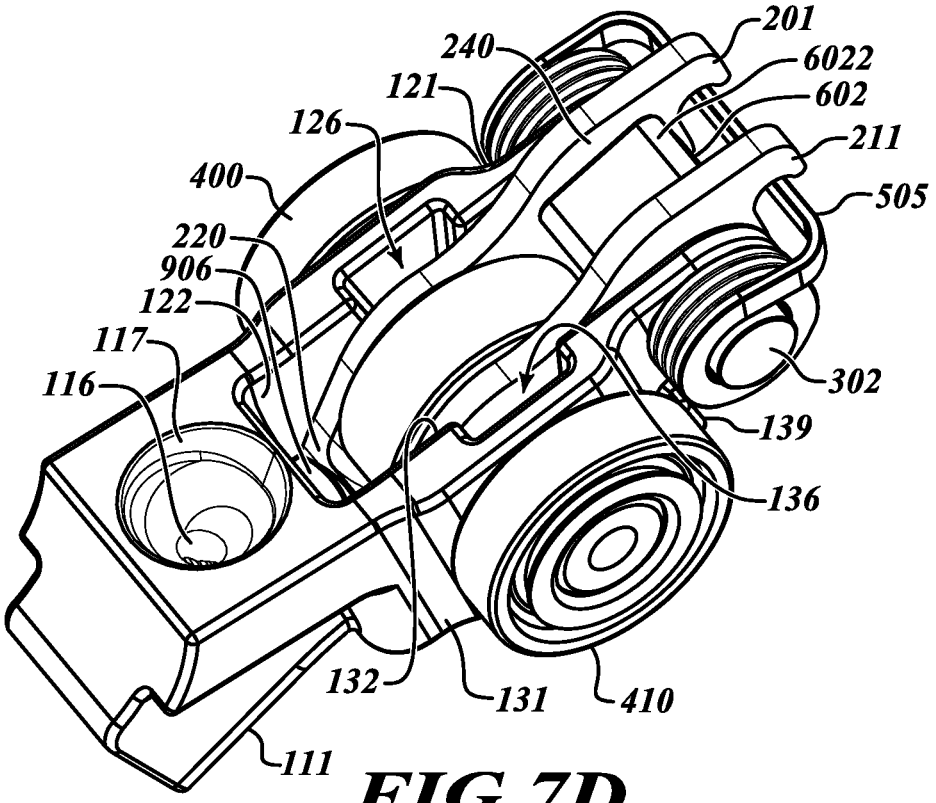
Figure 7E:
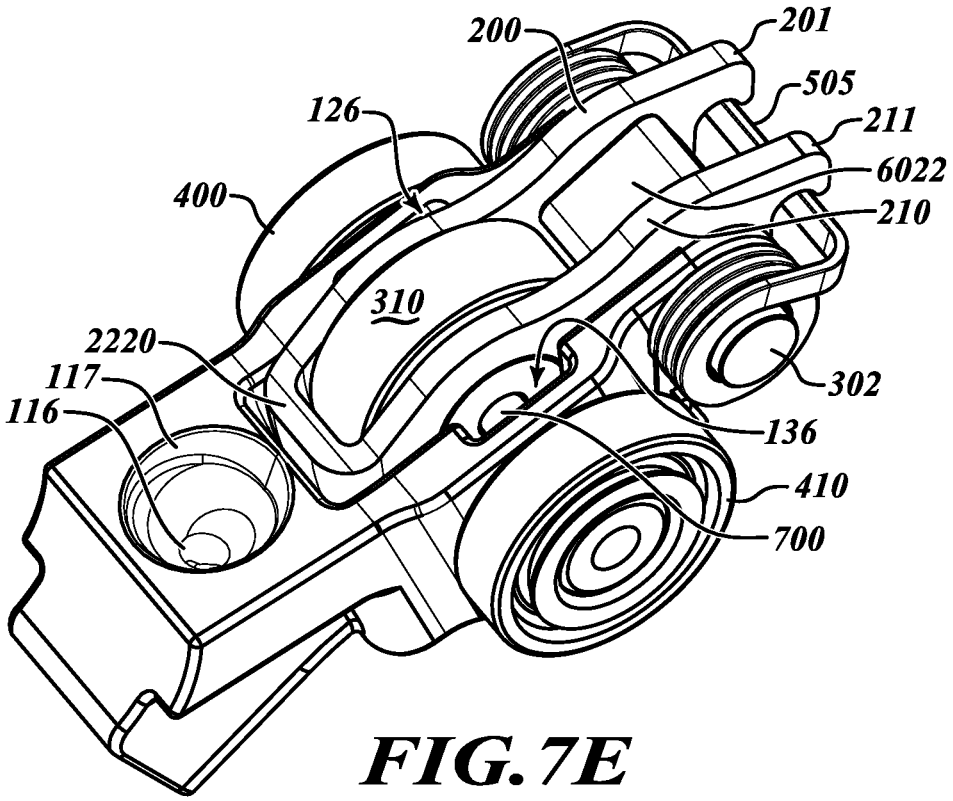

As the cam lobe 1003 rotates from an eccentric edge pressing the inner roller 310 to base circle pressing the inner roller, the springs 506, 507 uncoil, transferring force against the first and second spring ledges 129, 139 and against the spring props 201, 211 to once again bias the inner arm assembly 209 towards the latched condition, with the latch arm 220 above the latch seat 901, as in FIGS. 7C & 7D.

Hooked spring props 201, 211 can be integrally formed with inner arms 200, 210 and can comprise additional material for guiding the valve stem end 2001, such that a valve pallet 112 is no longer necessary. Scallop-shaped inner arm valve guides 240, 241 can be formed on the inner arms 200, 210 to flank the valve stem end 2001. Side-to-side motion of the valve stem end 2001 is thus restricted, though a small amount of sliding is permitted along the long axis of the SRFF, on the crown of the valve seat insert. Then, a variety of valve seat inserts 600, 601, 602 can be accommodated, commensurate with the below teachings. By appropriately securing the inner arms 200, 210 between the outer arms 120, 130, the inner arms 200, 210 can exert a clamp force on one or both the valve stem end 2001 and the valve seat insert to hold the items in place. The shared use of the pivot axle 302 over the valve end 12 promotes efficient use of parts, unifying the outer arms, inner arms, and valve seat insert with the single operation of inserting the pivot axle. It is further possible to unify the outer arms, inner arm, valve seat insert, and springs 506, 507 with the single operation of inserting the pivot axle 302.

Alternative rocker arms are shown in FIGS. 8A-8D. These Figures comprise separate springs 5060, 5070 mounted to the pivot axle 302. Springs 5060 & 5070 can be torsion springs with tangential spring ends extending at approximately 90 degrees. The slim design permits straight inner arms 200, 210 within substantially straight outer arms 120, 130 for a tight footprint. And, the latch assembly 900 can be laterally restricted to fit between the outboard (outer) sides 121, 131 of the outer arms 120, 130 fora slim design. Latch arm 220 can pivot between outer arms 120, 130 as above.

Figure 8A:
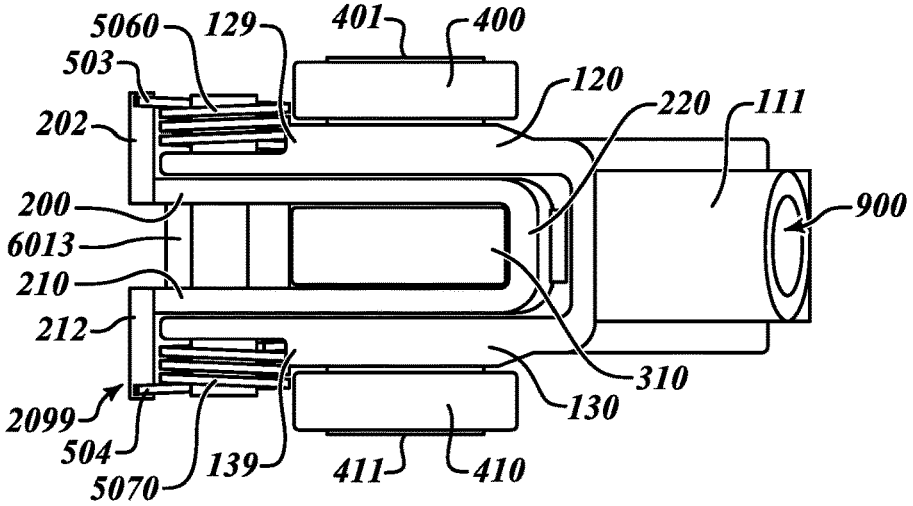
FIGS. 8A-8D show alternative rocker arm views comprising outboard springs on the valve end.
Figure 8B:
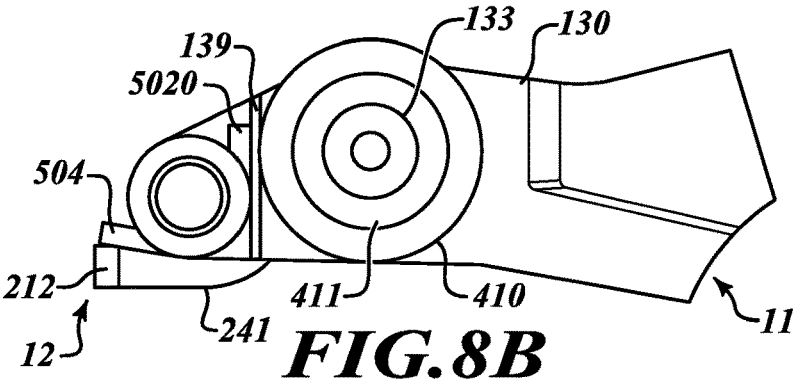
Figure 8C:
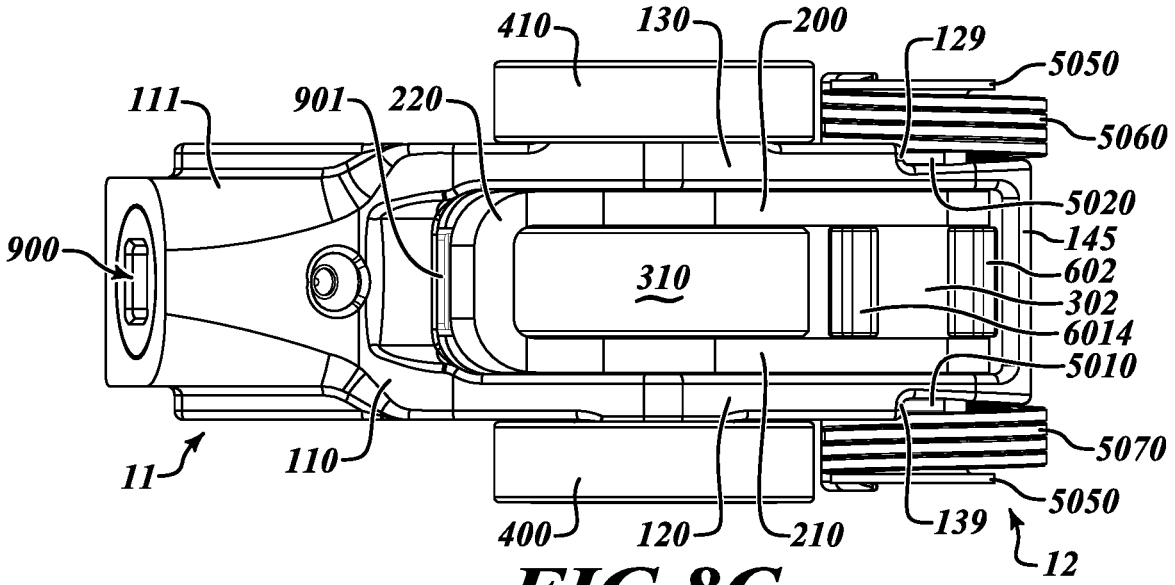

The top views of FIGS. 7A, 8A & 8C show that the springs 506 & 507 or 5060 & 5070 need not extend laterally past the outer rollers 400, 410. The outer (outboard) sides 121, 131 of the outer arms can be stepped to provide a recess or pocket for the springs 5060, 5070. Such a recess or pocket can also be provided above for springs 506, 507. The springs can then recede laterally in to the rocker arm, and seat with spring ends 501, 502 or 5010, 5020 pressed against ledges 129, 139. Ledges 129, 139 can form a surface of the recess or pocket and be part of the stepped shape of the outer sides 121, 131. Ledges 129, 139 can be longitudinally positioned between the pivot axle 302 and the rollers 310, 400, 410.

In FIGS. 8A & 8B, inner arm assembly 2099 can comprise inner arms 200, 210 with forward spring props 202, 212, latch arm 220, and inner roller 310. Spring ends 503, 504 react against laterally extending spring props 202, 212 while spring ends 5010, 5020 react against ledges 129, 139 on the outer sides 121, 131 of outer arms 120, 130. In FIGS. 8A & 8B, the laterally extending spring props 202, 212 extend out from the inner arms 200, 210 and the spring props 202, 212 are in front of the valve seat insert 602. First spring prop 202 on the first inner arm 200 is distal from the latch arm 220. Second spring prop 212 on the second inner arm 210 is distal from the latch arm 220. The spring props 202, 212 are the most distal aspects on the valve end 12. The spring props 202, 212 can extend so that they protrude from between the outer arms 120, 130. Inner arm valve guides 240, 241 can be included to function as above, and the lateral spring props 202, 212 can protrude therefrom.

Figure 8D:
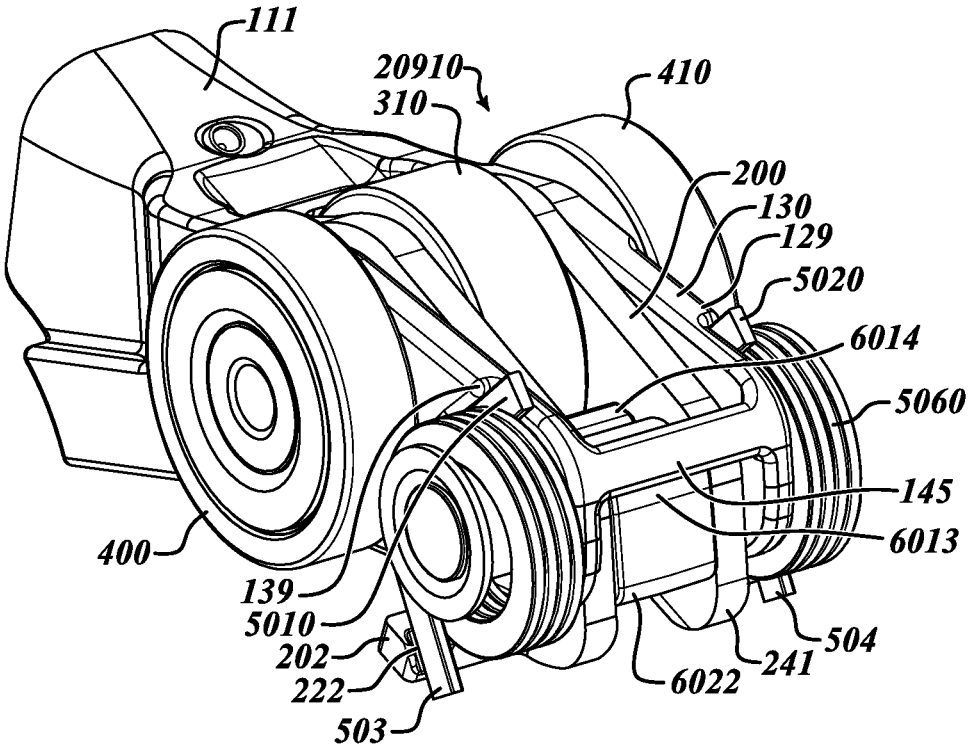

In FIGS. 8C & 8D, springs 5060, 5070 are rotated from the position shown in FIGS. 8A & 8B, and so are the angles of the ledges 129, 139 and the positions of the spring props 202, 212. Inner arm assembly 20910 can comprise inner arms 200, 210 with alternative spring prop locations, latch arm 220, and inner roller 310. The laterally extending spring props 202, 212 can be behind the valve seat insert 602 or can intersect a plane passing through the valve seat insert. The spring props 202, 212 can still be considered distal from the latch arm 220. It is possible for the spring prop 202, 212 to be in-line with the pivot axle 302. Or, the spring prop 202, 212 can be more centrally located (proximal to the center to the rocker arm). The spring props 202, 212 are shown with notches 222 for seating the spring ends 503, 504. Again, the spring props 202, 212 can extend so that they protrude from between the outer arms 120, 130. Inner arm valve guides 240, 241 can be included to function as above, and the lateral spring props 202, 212 can protrude therefrom. The FIGS. 8C & 8D embodiment can result in the lateral spring props 202, 212 being used as an inner arm assembly travel stop should the inner arm assembly 209 rotate enough to cause contact between the spring props 202, 212 and the outer arms 120, 130. In FIGS. 8C & 8D, an outer arm connector 145 can be included on the valve ends of the outer arms to provide stability.

Figure 9A:
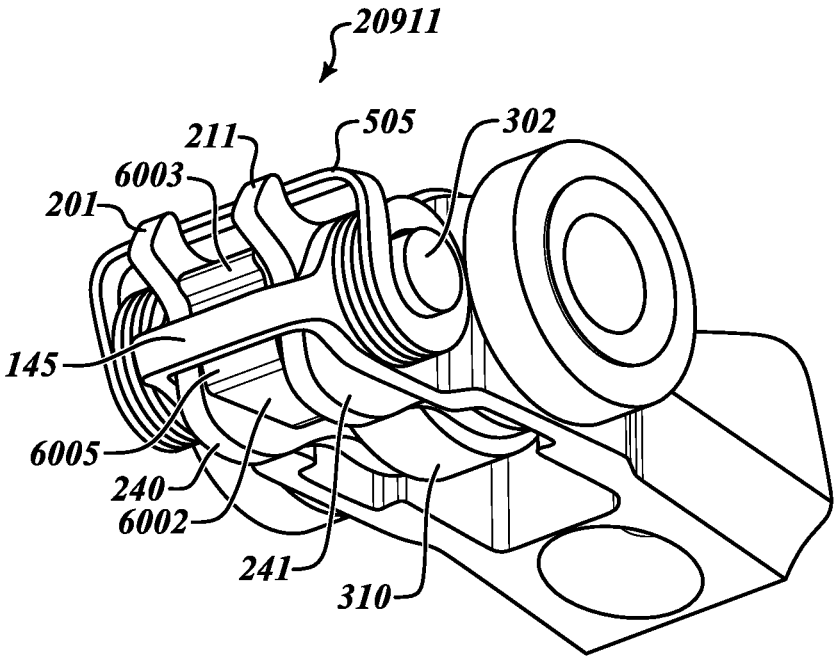
FIGS. 9A & 9B show alternative rocker arm views comprising outboard springs on the valve end and an alternative travel stop.
Figure 9B:
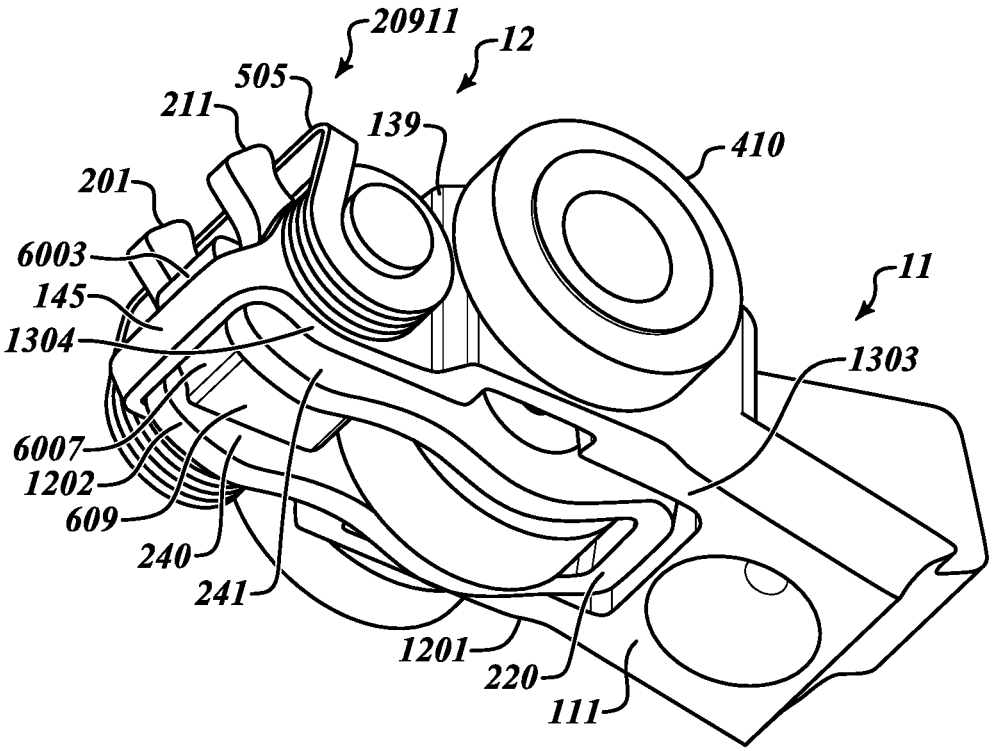

Another example of providing a travel stop on the outer arms 120, 130 can be seen in FIGS. 9A & 9B. Inner arm assembly 20911 can comprise inner arms 200, 210 with hooked spring props 201, 211, latch arm 220, and inner roller 310. An outer arm connector 145 can comprise a piece of material extending from one or both of the outer arms towards the other of the outer arms. The outer arm connector can lend structural stability when integrally formed with or integratively connected to the outer arms 120, 130. When in the latched condition, the inner arm assembly 209 is restricted from pivoting too far in the direction of the cam rail 1000, and latch arm 220 can only travel so far in the direction above latch seat 901 because the spring props, here hooked spring props 201, 211 contact the outer arm connector 145. One-piece spring 500 biases the spring props 201, 211 in the direction of the outer arm connector 145. Inner arm valve guides 240, 241 can be appropriately shaped to rotate between the outer arms 120, 130 and outer arm connector 145. In the unlatched condition, the spring props 201, 211 travel away from the outer arm connector 145.

Figure 12B:
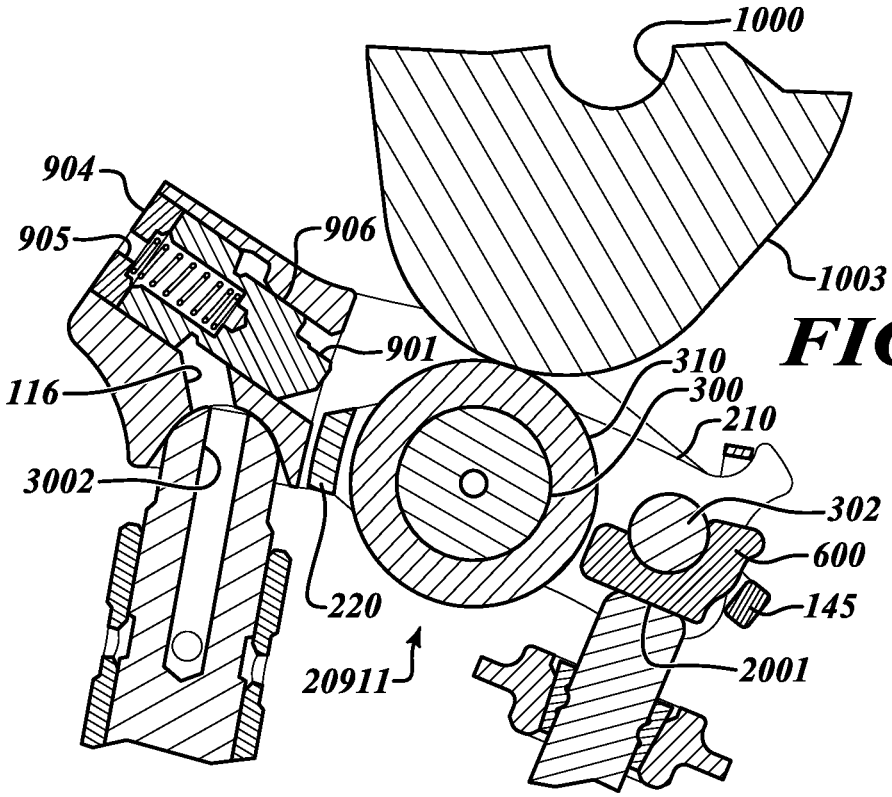

In FIGS. 12A & 12B, the outer arm connector 145 can provide alternative functionality. In FIG. 12A, in the latched condition, the valve seat insert 600 is "basketed" by the outer arm connector 145 to be within the rocker arm and prevented from falling out. In FIG. 12B, the outer arm connector 145 abuts the inner arm valve guide 240 to provide a travel stop for the inner arm assembly 20911.

Valve Seat Inserts

An additional aspect of the outer arm connector 145 can be understood with respect to the valve seat insert 600 (sometimes called an e-foot or elephant foot). In this embodiment, the valve seat insert 600 can comprise an "L" shaped. The outer arm connector 145 can offer a travel limit to the valve seat insert 600 as by providing a ledge against which an upper lip 6003 can catch against. Valve seat insert 600 can be squeezed by inner arms 200, 210, and can be molded to conform to at least a portion of pivot axle 302. The inner arm valve guides 240, 241 can flank the valve surface 6002 to provide, collectively, a seat for the valve stem end 2001. In some instances hooks, cleats or steps can be included on the inner arm valve guides 240, 241, similar to valve guides 115, to secure the valve stem end 2001. Valve seat insert can be inserted between the lost motion springs 506, 507 to add cross section stiffness.

Figure 11:
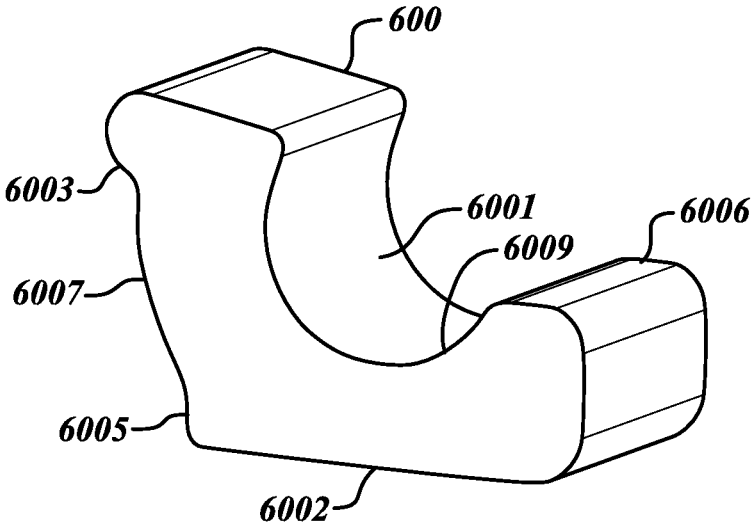
FIG. 11 shows an alternative valve seat insert.

Turning to FIG. 11, valve seat insert 600 can be constrained between first inside surface of the inner arm 200, a second inside surface of the inner arm 210, the outer arm connector 145, and the pivot axle 302. The valve seat insert 600 can comprise a crowned valve surface 6002. To be "crowned," the valve surface 6002 can comprise a curvature so as not to be completely flat. The valve seat insert 600 can comprise an outer leg 6007 and an inner leg 6009. The outer leg can comprise an upper lip 6003 configured to catch against the outer arm connector 145 when the latch arm 220 is pivoted to a first position, such as the latched position. The valve seat insert 600 can comprise a lower lip 6005 configured to catch against the outer arm connector 145 when the latch arm 220 is pivoted to a second position, such as the unlatched or lost motion position. The inner leg can comprise an inner knob or knurl 6006 configured to curl around a portion of the axle 602. The valve seat can comprise an axle groove 6001 for seating the structure flush against the first (pivot) axle 302.

Figure 10A:
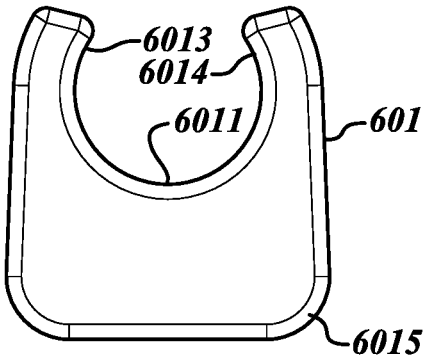
FIGS. 10A & 10B show an alternative valve seat insert.
Figure 10B:
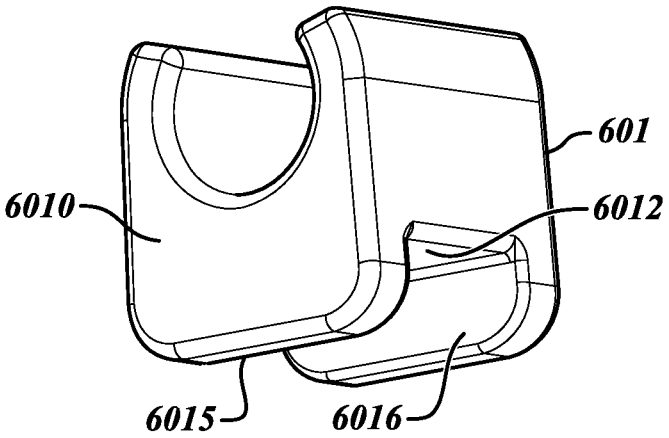

Turning to FIGS. 10A & 10B, and recalling aspects of FIGS. 7C-7F & 8D, alternative valve seat inserts 601, 602 will be discussed. Utilizing valve seat insert 601 or 602, it is not necessary to "basket" the valve seat insert via the outer arm connector 145, and so the outer arm connector 145 can be omitted. To facilitate this, valve seat insert 601 or 602 can be constrained between the first inside surface 250 of the inner arm 200, the second inside surface 251 of the inner arm 210, and the pivot axle 302. The valve seat insert 601 or 602 can comprise a front cusp 6013 configured to encircle a portion of the pivot axle 302 and a rear cusp 6014 configured to encircle a second portion of the pivot axle 302. The valve seat insert 601 or 602 can hang from the pivot axle 302 via the front cusp and the rear cusp. The design permits the valve seat insert to be clipped to the pivot axle or, permits an assembly method whereby inserting the pivot axle unifies the outer arms, inner arms, valve seat insert, and springs. Valve seat insert can be inserted between the lost motion springs 506, 507 or 5060, 5070 to add cross section stiffness The valve seat can further comprise a valve seat body 6010 joined to the front cusp 6013 and to the rear cusp 6014. The valve seat body can be cuboidal, such that it resembles a cube or is an approximate cube shape.

The valve seat body can be flat or can comprise a crowned valve surface 6012. The valve seat body can comprise an axle groove 6011 for seating the valve seat flush against the axle.

Figure 7F:
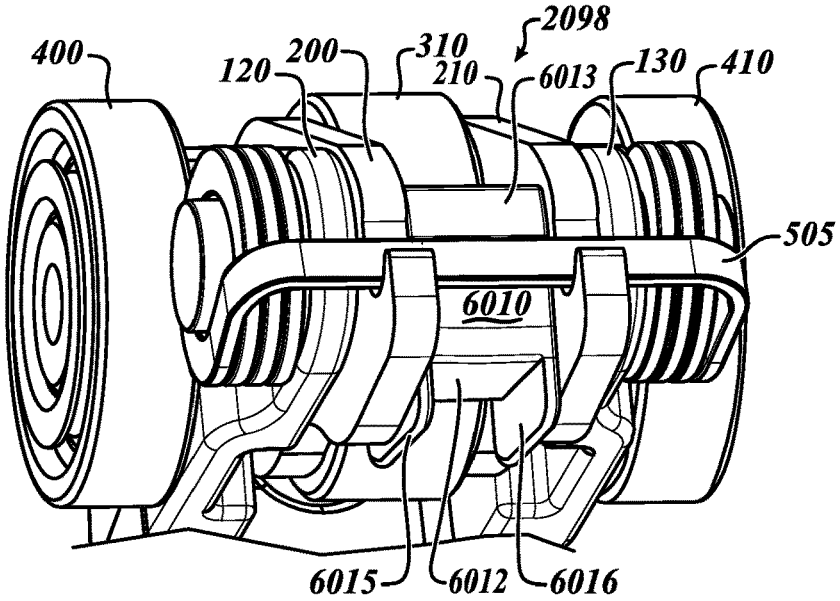

The valve seat insert 602 of FIGS. 7C-7E, 8A, 8B does not comprise valve guides for restricting the lateral motion of the valve stem end 2001, so in some instances hooks, cleats or steps can be included on the inner arm valve guides 240, 241, similar to valve guides 115, to laterally secure the valve stem end 2001. Alternatively, while it is possible to rely on the inner arm valve guides 240, 241 to restrict side-to-side valve stem end motion on the e-foot, FIGS. 7F & 10B illustrate a valve seat insert 601 comprising first and second valve guides 6015 & 6016. The first valve guide 6015 and the second valve guide 6015 can extend away from the valve seat body 6010, the first valve guide and the second valve guide configured to constrain a valve stem end 2001. Then, the inner arms 200, 210 can be lightweighted by removing the valve guides 240, 241. So, the inner arm assembly 2097 of FIGS. 7A-7E can comprise inner arms 200, 210, latch arm 220, and inner roller 310, where inner arms 200, 241 comprise inner arm valve guides 240, 241. But, in FIG. 7F, inner arm assembly 2098 can comprise inner arms 200, 210 without inner arm valve guides 240, 241, latch arm 220, and inner roller 310. Both inner arm assemblies 2097 & 2098 can comprise the hooked spring props 201, 211.

Rocker arms can comprise various mechanisms for retaining a valve stem 2000 for actuation. A valve seat can be distal from the pivot body 11. A first example of a valve seat is a valve pallet 112 that can be integrated, or integrally formed, between the outer arms 120, 130. The valve pallet 112 can comprise a first side 113 for biasing a spring and a second side 114 for receiving a valve stem end 2001. When the cam lobes 1001, 1002, 1003 press on the rocker arm, the rocker arm pivots from the pivot body 111, tipping the rocker arm and pushing the valve pallet 112 towards the cylinder block. This tipping can be seen by comparing FIGS. 12A & 12B. The second side 114 of the valve pallet 112 can comprise a crowned surface, so that it is not perfectly flat, and the valve stem end 2001 can slide slightly on the crowned surface. Valve guides 115 can extend down from the valve pallet to restrain the valve stem motion. The valve pallet 112 can restrict the range of motion of the pivoting inner arms 200, 210.

Alternatively, a valve seat can comprise a valve seat insert 600, 601, 602 that can be retained in the rocker arm. One design comprises valve guides formed on the inner arms 200, 210. The valve guides 240, 241 can be an extension of the inner arms, such as a scallop or other ridge or knurl. Or, the valve guides 240, 241 can comprise hooked ends or cleats to grip the valve stem end 2001. When the inner arms 200, 210 are mounted between the outer arms 120, 130, the first axle 302 constrains the valve seat insert from the top. The valve guides, when hooked or cleated, constrain the valve guide insert from the bottom, and the inside surfaces 250, 251 of the inner arms constrain the valve guide insert at the sides. The valve seat being constrained between the inner arms 200, 210 instead of between the outer arms 120, 130 yields a higher range of motion for pivoting the inner arm assembly 209.

A rocker arm, comprises a first outer arm 120 comprising a first inner side 122, a first outer side 121, a first end 1201, and a second end 1202. A second outer arm 130 comprises a second inner side 132, a second outer side 131, a third end 1303, and a fourth end 1304. A pivot body 111 joins the first end of the first outer arm to the third end of the second outer arm. An outer arm connector 145 can span between the second end of the first outer arm and the fourth end of the second outer arm. An actuatable latch mechanism can reciprocate within the pivot body.

A first inner arm 200 comprises a first inside surface 250 and a first outside surface 260. A second inner arm 210 comprises a second inside surface 251 and a second outside surface 261. A latch arm 220 can be between the first inner arm and the second inner arm, the latch seat pivotable adjacent the pivot body 111 so as to swing past a latch mechanism 900 within the pivot body 111. The latch mechanism 900 can comprise a latch finger 906 that can reciprocate, retracting to release the latch seat 901 from near or against the latch arm 220 of the inner arms 200, 210 or extending to adjoin the latch seat 901 to the latch arm 220 and prevent significant motion of the inner arms.

First axle 302 can join the first inner arm 200 and the second inner arm 210 to pivot between the first outer arm 120 and the second outer arm 130. The first outside surface 260 adjoins the first inner side 122 and the second outside surface 261 adjoins the second inner side 132.

Pump Down Stop

To obtain controlled valvetrain dynamics at high speeds, the lost motion spring 500, 5000, 506, 507, 5060, 5070 on a switching roller finger follower (SRFF) must be of sufficient stiffness. When the stiffness is achieved, it quite often creates a force greater than the hydraulic lash adjuster (HLA) 3000, which will cause the HLA to "pump down." Non-hydraulic lash adjusters can experience strain from the spring. These are undesired outcomes of the spring design. So, travel stops can be designed in to the SRFF, such as those already disclosed above and the following pump-down stop pins 700, 701, 703.

A pump-down stop pin 700, 701, 703 provides hydraulic lash adjuster pump down stop protection. The designs solve the pump-down problem in a unique way for the three roller rocker arm design. FIGS. 4G & 5A-5E show various alternatives.

While a three roller rocker arm has been described, at times, sliders, such as pads or other sliding surfaces, can be used in place of the rollers 400, 410 or 310. The travel stops disclosed herein can be integrated in whether the rocker arm uses rollers or sliders, so that it is advantageous to control the motion of the inner arm with respect to the main body 110. So, it is advantageous to include a pump-down stop, such as a pin 700, extending from the second (bearing) axle 300. Depending on the diameter of the bearing axle 300, and depending on the diameter of one of the post receptacles 124, 125, 134, or 135, the pump down stop can alternatively be an integrally formed extension of the bearing axle 300. Integrally formed pin and bearing axle can be drop-in assembled.

Pump-down stop pin 700, 701, 703 can be inserted through one of the post receptacles 124, 125, 134, 135, 1351 in posts 123, 133 as described in more detail below. While only one outer arm 120 or 130 need be provided with a post receptacle for inserting the pump-down stop, both arms 120 and 130 can be formed with a receptacle for options during manufacture or for lightweighting or structural balance. While only one pump-down stop is illustrated in several of the figures, two can be used.

Figure 4G:
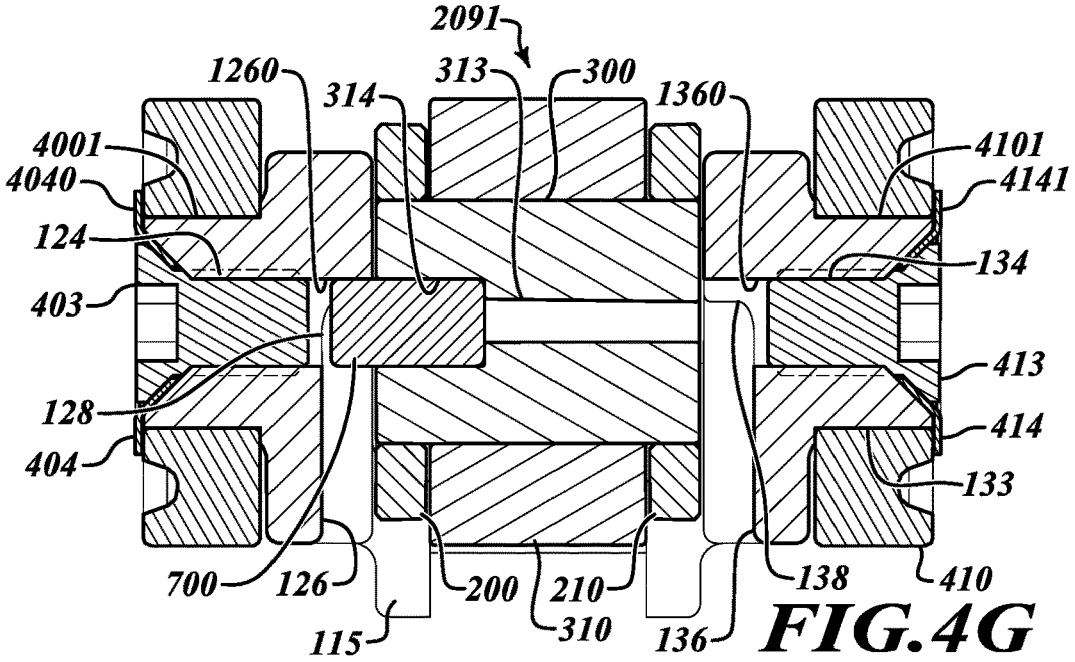

Turning to FIG. 4G, inner sides 122, 132 of the outer arms 120, 130 are formed with grooves 126, 136 to serve as pump-down guides for the pump-down stop. For example, pin 700 can move through one of the grooves 126, 136 as the inner arms 200, 210 pivot within the outer arms 120, 130. A limiting surface 1260, 1360 can be included in the inner sides 122, 132 so that the pump down stop travel is limited. When spring forces from one of springs 500, 506, 507, 509, 5060, 5070 lifts the latch arm 220 and biases the inner roller 310 towards cam lobe 1003 and/or the latch arm 220 to be above latch seat 901, the travel of the latch arm 220 can be limited by the pump-down stop seating against the limiting surface 1260. The grooves 126, 136 can be left unobstructed at the valve-stem side of main body 110 so as to permit a large pivot angle of the inner arms 200, 210 with respect to the outer arms 120, 130.

Figure 5A:
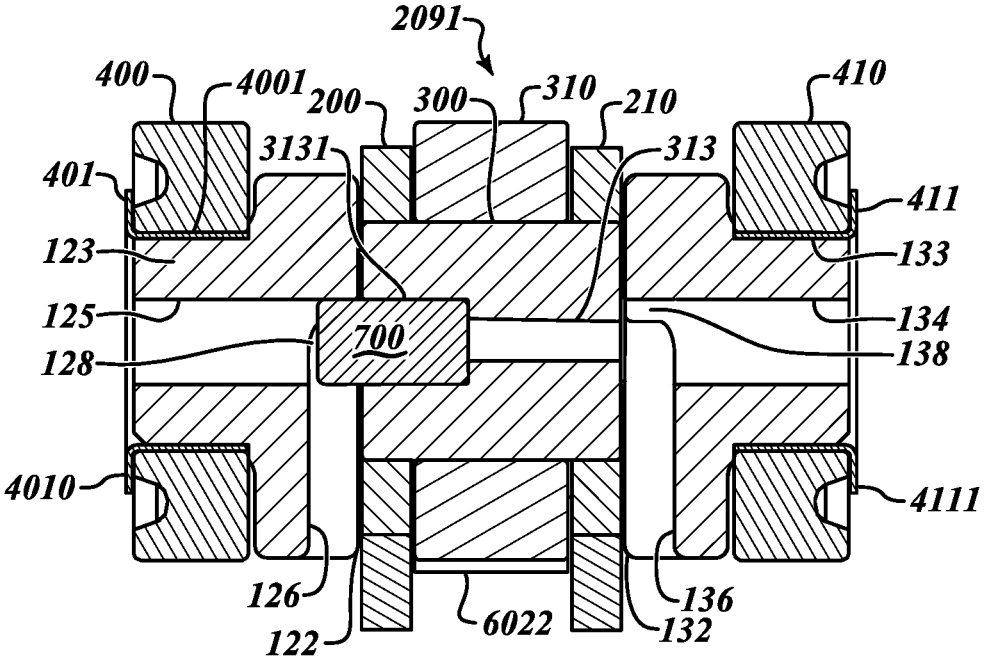
FIGS. 5A-5E show alternative travel stops and roller configurations.

Turning to FIGS. 4G & 5A, inner arm assembly 2091 can comprise inner arms 200, 210, latch arm 220, inner roller 310, and pin 700. Inner roller 310 is shown as comprising multiple layers so that the portion of inner roller 310 that contacts cam lobe 1003 is a different material than bearing axle 300. But, a single, stepped material can be used instead. Of note, however, is that the bearing axle diameter can be adjusted based on the application. For example, it is possible to reduce the weight and inertia of the inner roller by using a smaller diameter bearing axle 300 seated in the inner arms 200, 210. Or, it is possible to lightweight by making the diameter of hollow passageway 313 larger.

Pin 700 can be inserted in pump-down stop receptacle 314 prior to dropping the inner arm assembly 209 within the outer arms 120, 130. Or, pin 700 can be inserted through the post receptacle 125 before or after the pivot axle 302 unifies the inner arm assembly 209 to the outer arms 120, 130. A positioning tool can be inserted through post receptacle 134 or 135 and through hollow passageway 313 to fix the depth of pin 700 within pump-down stop receptacle 314, or to stabilize the location of pump-down stop receptacle as the pin 700 is inserted. A clearance 128 can be maintained between the pin 700 and the fastener 413, or the clearance 128 can be maintained between the pin 700 and the post receptacle. While FIG. 4G comprises threaded post receptacles 124, 134, it is possible to avoid marring such threading via the alignment tool as by using the alternative press-on bushings 401, 411 of FIG. 5A. Then, post receptacles 125, 135 can be unthreaded or smooth.

Figure 5B:
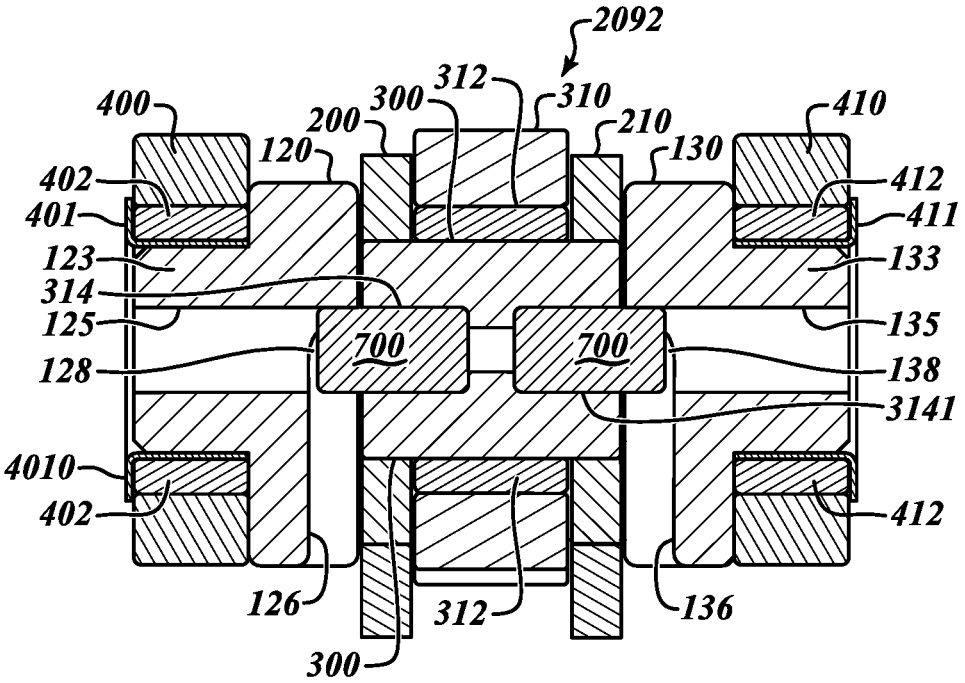

FIG. 5B shows an alternative travel stop, as by comprising two pins 700. Inner arm assembly 2092 can comprise inner arms 200, 210, latch arm 220, inner roller 310, and two pins 700. Also, inner roller 310 can comprise a rotatable bearing 3101 mounted on the second axle 300. Needles 312 can be mounted between the second axle 300 and the rotatable bearing to form a needle bearing assembly. Utilizing two pins 700 can comprise clearance 128 and mirror-image clearance 138. While pins 700 can be assembled in advance of joining the inner arm assembly 209 to the outer arms, it is possible to insert one pin 700 through post receptacle 125 and in to pump-down stop receptacle 313, then insert the other pin 700 through post receptacle 135 and in to pump-down stop receptacle 3131.

Figure 5C:
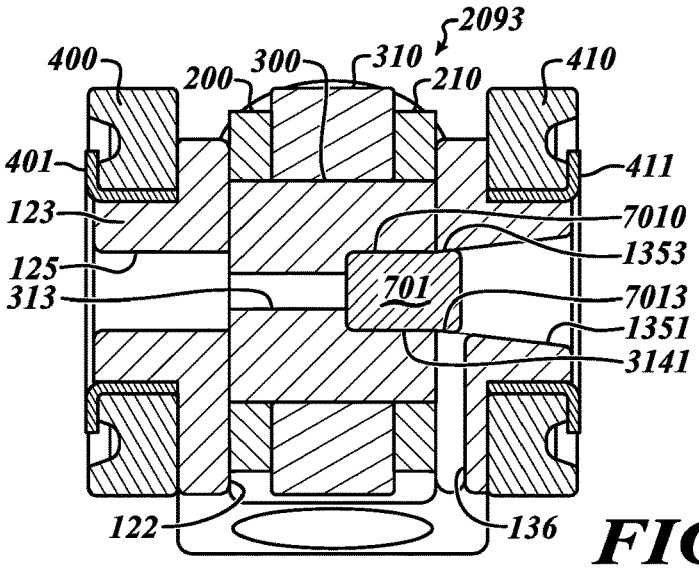
Figure 5D:
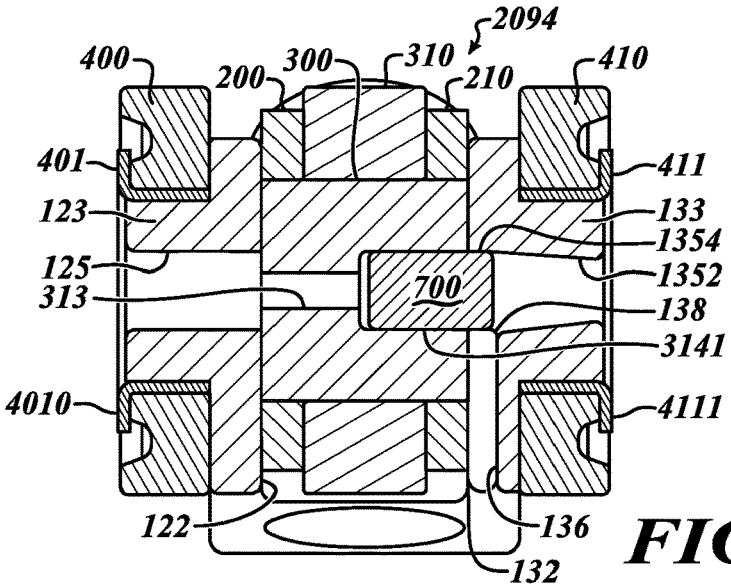
Figure 5E:
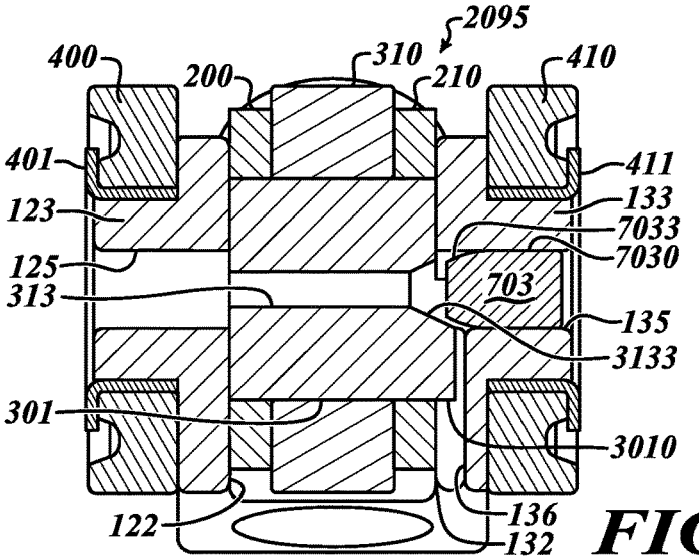

Further alternatives are shown and described in FIGS. 5C-5E. One strategy to set lash between the rocker arm inner roller 310 and the cam lobe 1003 of a 2 step rocker arm is to control tolerances on the inner roller 310, for example, one or more of the inner diameters (ID) and outer diameters (OD) of the rotatable bearing 3101, needles 312, and bearing axle 300. This stack up can add up to many tightly controlled tolerances which makes for costly manufacturing processes. Adding tolerances for the pin 700 alignment increases the stack-up, despite the benefits inured by the travel stop.

Turning to FIG. 5C, inner arm assembly 2093 can comprise inner arms 200, 210, latch arm 220, inner roller 310, and a partially tapered pin 701. To reduce cost, one could use a tapered pin 701, tapered bore for the post receptacle 1351, and pump-down stop receptacle 314 or 3141 for seating the tapered pin 701. One could then control stack up tolerance by the depth of press of the pin 701. The pin 701 can comprise a cylindrical pin body 7010 for fitting in a cylindrical pump-down stop receptacle 314 or 3141. Then, a tapered portion 7013 of the pin can be aligned with respect to the tapered bore of post receptacle 1351.

The control of lash between the cams on cam rail 1000 and the rocker arm rollers 400, 410, 310, in the illustrated case the inner roller 310, can comprise a cost effective way to control stack-up during manufacturing. Additional means are discussed below for using an adjustable means using a taper on a pin or bore.

Instead of an inner roller on a bearing axle, an alternative rocker arm can comprise a slider pad. The slider pan can span between a pair of inner arms. Or, a single inner arm can be used. An axle or other bridge portion between the outer arms can comprise at least a control pin mount, such as receptacles 3131, 314, 3141 or 135.

In FIG. 5D, inner arm assembly 2094 can comprise inner arms 200, 210, latch arm 220, inner roller 310, and a cylindrical pin 700. Pin 700 is cylindrical along its body, as is receptacle 3131. The taper angle of the post receptacle 1352, however, is reversed with respect to FIG. 5C. So, in FIG. 5C, the taper angle increases from the inner side 132 to the outer side 131. But, in FIG. 5D, taper angle decreases from the inner side 132 to the outer side 131. A clearance 138 can be maintained between the end of the pin 700 and the through-portion of the post receptacle 1352, but the position of the pin 700 against the overhanging portion of the tapered post receptacle 1352 will control the location of the travel stop, and hence the lash adjustment. FIG. 5D also illustrates that inner side 122 can be parallel adjacent with outside surface 260.

As in FIG. 5E, inner arm assembly 2095 can comprise inner arms 200, 210, latch arm 220, and an inner roller 310 comprising a control pin stop 3010. Inner roller design can comprise a bearing axle 300 that comprises a control pin stop 3010 or overhang jutting out from the bearing axle in to the pump-down guide 136. A tapered edge 3133 can be included on the control pin stop 3010. One of the outer arms 130 can comprise the a mount for the pin 703, such as post receptacle 135. The pin 703 can comprise a cylindrical body 7030 and a tapered portion 7033. While tapered portion 7033 of pin 701 increased the circumference of the pin as the taper extended from the cylindrical pin body 7030, this pin 703 decreases the circumference of the pin as the taper extends from the cylindrical pin body 7030. The inner arm assembly 209 comprises a tapered edge 3133 as a control pin stop. Setting the pin 703 in the post receptacle 135 or other mount with respect to the control pin stop sets the relative motion of the inner arm assembly 209 with respect to the outer arms 120, 130.

Instead of using only tolerance to control the lash, one could design an adjustable stop pin 700, 701, 703 according to the instant disclosure. When tapered, the pin 701. 703 can taper at the same angle as the tapered bore against which is provided a travel stop (control pin stop). To adjust the lash, one presses the pin into the pin bore to a given depth: more depth for more lash or less depth for less lash in the example of FIG. 5C. This depth will depend on the amount of lash one wants between the inner roller 310 and the inner cam lobe 1003. One could use a gauge or other alignment tool to hold the rocker arm in a position that aligns the inner and outer rollers 400, 410 to the desired lash for the operating state. Then, when the stop pin 701, 703 is inserted and set (or pressed into its bore) it is pressed to the depth that aligns the parts with the gauge or other alignment tool.

Consistent with these examples, a rocker arm can comprise a first outer arm 120 and a second outer arm 130 joined by a pivot body 111. One of the first outer arm or the second outer arm comprises an inner side 122, 132, and the inner side comprises a limiting surface 1260, 1360, 1352, 1354. Second (bearing) axle 300 can be between the first inner arm and the second inner arm. A pin 700, 701 can extend from the second axle 300 towards one of the first outer arm or the second outer arm. The pin can be configured to reciprocate towards and away from the limiting surface when the first inner arm and the second inner arm pivot between the first outer arm and the second outer arm.

The inner side can further comprise a groove 126, 136 with the limiting surface 1260, 1360, 1352, 1354, and the pin 700, 701 can be configured to pivot within the groove towards and away from the limiting surface when the first inner arm and the second inner arm pivot between the first outer arm and the second outer arm (for example, when the inner arm assembly 209 travels in lost motion).

A rocker arm can comprise a pair of outer arms 120, 130 comprising at least one control pin port, such as port receptacles 124, 134, 125, 135, 1351, 1352 through at least one of the outer arms of the pair of outer arms. An inner arm assembly 209 can be pivotable with respect to the outer arms. The inner arm assembly can comprise at least one pin mount, such as receptacles 3131, 314, 3141, which can be part of an axle 300 or other portion of the inner arm assembly 209. A control pin 701, 703 can comprise a tapered portion 7033, 7013 and a body portion 7030, 7013, the control pin body inserted in to the control pin mount, and at least a portion of the tapered portion selectively in contact with at least a portion of the control pin port.

The pump-down stops disclosed herein can be used with less complicated rocker arms that those disclosed in the figures. For example, the pump-down stops can be used in a rocker arm lacking the cantilevered rollers 400, 410. So, a rocker arm can comprise a pair of outer arms comprising at least one limiting surface 260, 360, 1353, 1354, on at least one of the outer arms of the pair of outer arms. An inner arm assembly can be pivotable with respect to the outer arms. A control pin 700, 701 can be mounted to the inner arm so as to limit the travel of the inner arm assembly with respect to the outer arms.

Or, a rocker arm can comprise a pair of outer arms comprising at least one control pin mount, such as port receptacle 135 on at least one of the outer arms of the pair of outer arms. An inner arm assembly can be pivotable with respect to the outer arms. The inner arm can comprise a limiting surface such as tapered edge 3133. A control pin, such as pin 703 comprising a tapered portion and a body portion, can be inserted in to the control pin mount. At least a portion of the tapered portion 7033 can selectively be in contact with at least a portion of the limiting surface.

Roller Retention for Three Roller Rocker Arm

Using rollers, such as roller bearings, needle bearings, or wheels, on a rocker arm reduces friction losses when the actuation mechanism pushes against the rocker arm. Consider a type II valvetrain comprising an overhead cam rail 1000. Eccentrically shaped cam lobes are mounted to rotate with the cam rail 1000, and the shape of the lobes 1001, 1002, 1003 and the rotation rate of the cam rail 1000 controls the opening and closing of the engine valves. If using immobile surfaces, such as slider pads, the cam lobes scrape along the slider pads, which can lead to energy loss in the system. Using rollers on the rocker arm, instead of immobile surfaces like slider pads, lowers friction losses. So, it can be advantageous to use a roller 310 for the lost motion pivoting of the inner arms 200, 210 and it can be further advantageous to use first and second outer rollers 400, 410 on the first and second outer arms 120, 130. The roller 310 can comprise a needle roller bearing, as above. Like and additional adaptations for the outer rollers 400, 410 will be detailed below.

By cantilevering the outer rollers 400, 410 on posts 123, 133 on outer sides 121, 131 of the outer arms 120, 130, assembly and manufacture benefits inure.

A rocker arm can comprise a first outer arm 120 comprising a first inner side 122 and a first outer side 121, the first outer side comprising a first cantilevered post 123. A first roller 400 can be mounted to the first cantilevered post 123. A second outer arm 130 comprises a second inner side 132 and a second outer side 131, the second inner side 132 facing the first inner side 122. The second outer side 131 comprises a second cantilevered post 133. A second roller 410 is mounted to the second cantilevered post 133.

The first cantilevered post 123 can be integrally formed with the first outer side 121, as by molding, machining, printing or the like. Likewise, the second cantilevered post 133 can be integrally formed with the second outer side 131. First roller 400 can be cantilevered on mounting post 123 in-line with the second axle 300, which can be in-line with the second roller 410.

The first and second cantilevered posts 123, 133 can comprise first and second post receptacles 124, 134 or 125, 135 configured to receive a pin 700 and or a fastener 403, 413. The fastener can be a rivet or the like. Or, first and second post receptacles 124, 134 can be threaded to receive a threaded fastener 402, 413. The first roller 400 can comprise a center hole 4001, and the first roller can be mounted to the first cantilevered post by inserting a fastener such as screw or rivet 403, 413 or bushing 401, 411 through the center hole 4001 and by securing the fastener to the first cantilevered post 123. The outer rollers can be retained by extensions 4040, 4041 on the washers being held in place by screwing in the fasteners. Like process can be used for second roller 410 comprising center hole 4101.

The first roller 400 can be mounted to the first cantilevered post 123 by inserting a fastener 403 through the center hole 4001 and in to the first post receptacle 124 or 134. A washer 404, 414 or bushing can be inserted between the respective first roller 400 or second roller 410 and the fastener 403, 413 to facilitate rotation of the outer rollers 400, 410, as can be seen in FIG. 4G.

Alternatively, as seen in FIG. 5A, the first and second cantilevered posts 123, 133 can comprise outer surfaces, and fasteners 401, 411 can be fitted to the outer surfaces. The fasteners 401, 411 can be T-bushings, and the T-bushings can be press-fit to the outer surface. T-bushings can function to facilitate rotation of the outer rollers and to retain the outer rollers. By using the "T" cross-section, extensions 4010, 4111 on the T-bushings provides lateral travel limitations to the outer rollers 400, 410, which prevents twisting forces from conveying to the cam lobes 1001, 1002. Similar extensions 4040, 4141 can be provided on the washers 404, 414.

As shown in FIG. 5B, the rocker arm can further comprise needles 402, 412 between the outer rollers 400, 410. The outer rollers 400, 410 can constitute outer races for bearing assemblies, and the bushings 401, 411 can constitute inner races for the bearing assemblies. The center holes 4001, 4101 can be larger diameter to accommodate the needles 402, 412. Extensions 4010, 4111 can restrict the needles 402, 412 and the outer rollers 400, 410 from moving on the cantilevered posts 123, 133.

Other implementations will be apparent to those skilled in the art from consideration of the specification and practice of the examples disclosed herein.

What is claimed is:

1. A rocker arm for a valve train, comprising:

a main body comprising a pivot end, a valve end, a first side, and a second side, the first side comprising a first outer surface and a first inner surface opposite to the first outer surface, the second side comprising a second outer surface and a second inner surface opposite to the second outer surface;

a first post connected to the first side and extending away from the first outer surface of the first side;

a second post connected to the second side and extending away from the second outer surface of the second side oppositely from the first post;

a latch mechanism within the pivot end of the main body, the latch mechanism comprising a latch finger configured to selectively move between a latched position, wherein the latch finger extends towards the valve end, and an unlatched position, wherein the latch finger withdraws away from the valve end, the latch finger comprising a latch surface;

an inner arm assembly pivoting from the valve end between the first side and the second side, the inner arm assembly comprising a latch arm pivotable from a position above the latch surface to a position below the latch surface, the inner arm assembly comprising a bearing axle and an inner roller rotatable on the bearing axle;

a first roller connected to rotate on the first post;

a second roller connected to rotate on the second post;

a bearing axle disposed in the inner arm assembly for rotatably supporting an inner roller between the first roller and the second roller, the bearing axle terminating in the inner arm assembly without extending into the first inner surface of the first side or the second inner surface of the second side; and at least one biasing mechanism biasing the latch arm towards the position above the latch surface.

2. The rocker arm of claim 1, wherein the inner arm assembly comprises a pair of inner arms joined by the latch arm, wherein the bearing axle extends through the pair of inner arms to support the inner roller, wherein the at least one biasing mechanism comprises a first spring mounted on the first side and a second spring mounted on the second side, wherein the first side further comprises a first ledge, wherein the second side further comprises a second ledge, wherein the first spring is biased between the first ledge and the bearing axle, and wherein the second spring is biased between the second ledge and the bearing axle.

3. The rocker arm of claim 1, further comprising a pivot axle joining the inner arm assembly to the main body at the valve end, wherein the at least one biasing mechanism is coiled around the pivot axle.

4. The rocker arm of claim 3, further comprising a spring prop on the inner arm assembly between the pivot axle and the latch arm, wherein the at least one biasing mechanism is biased against the spring prop.

5. The rocker arm of claim 4, further comprising a valve seat for a valve assembly on the valve end, the valve seat positioned between the first side and the second side, wherein the at least one biasing mechanism is biased against the valve seat.

6. The rocker arm of claim 5, wherein the valve seat restricts the pivoting of the inner arm assembly.

7. The rocker arm of claim 5, wherein the valve assembly comprises a valve stem seated against the valve seat.

8. The rocker arm of claim 1, further comprising a hydraulic lash adjuster mounted to the pivot end.

9. The rocker arm of claim 1, wherein the latch arm is configured to latch against the latch surface when the latch finger is in the latched position and the latch arm is configured to rotate past the latch surface when the latch finger is in the unlatched position.

10. The rocker arm of claim 1, wherein the first post is integrally formed in a unitary construction with the first side, and the second post is integrally formed in a unitary construction with the second side.

11. The rocker arm of claim 1, wherein the bearing axle and either the first or second post lacks a locking pin mechanism for selectively engaging one another so as to selectively lock the inner arm assembly to the main body.

12. The rocker arm of claim 1, further comprising a pivot axle connecting the inner arm assembly to the main body.

13. The rocker arm of claim 12, wherein the latch mechanism is in-line with the pivot axle and bearing axle.

14. The rocker arm of claim 12, wherein the pivot axle and the bearing axle are in-line in a first plane, and wherein the latch mechanism is in a second plane angled away from the first plane.

15. A valvetrain, comprising:

a rocker arm for a valve train, comprising:

a main body comprising a pivot end, a valve end, a first side, and a second side, the first side comprising a first outer surface and a first inner surface opposite to the first outer surface, the second side comprising a second outer surface and a second inner surface opposite to the second outer surface;

a first post connected to the first side and extending away from the first outer surface of the first side;

a second post connected to the second side and extending away from the second outer surface of the second side oppositely from the first post;

a latch mechanism within the pivot end of the main body, the latch mechanism comprising a latch finger configured to selectively move between a latched position, wherein the latch finger extends towards the valve end, and an unlatched position, wherein the latch finger withdraws away from the valve end, the latch finger comprising a latch surface;

an inner arm assembly pivoting from the valve end between the first side and the second side, the inner arm assembly comprising a latch arm pivotable from a position above the latch surface to a position below the latch surface, the inner arm assembly comprising a bearing axle and an inner roller rotatable on the bearing axle;

a first roller connected to rotate on the first post;

a second roller connected to rotate on the second post; and at least one biasing mechanism biasing the latch arm towards the position above the latch surface; and a set of three rotating cam lobes respectively configured to press upon each of the first roller, the second roller, and the inner roller, wherein the bearing axle terminates in the inner arm assembly without extending into the first inner surface of the first side or the second inner surface of the second side, and wherein the at least one biasing mechanism biases the inner roller towards the set of rotating cam lobes.

16. A valvetrain, comprising:

a rocker arm for a valve train, comprising:

a main body comprising a pivot end, a valve end, a first side, and a second side, the first side comprising a first outer surface and a first inner surface opposite to the first outer surface, the second side comprising a second outer surface and a second inner surface opposite to the second outer surface;

a first post connected to the first side and extending away from the first outer surface of the first side;

a second post connected to the second side and extending away from the second outer surface of the second side oppositely from the first post;

a latch mechanism within the pivot end of the main body, the latch mechanism comprising a latch finger configured to selectively move between a latched position, wherein the latch finger extends towards the valve end, and an unlatched position, wherein the latch finger withdraws away from the valve end, the latch finger comprising a latch surface;

an inner arm assembly pivoting from the valve end between the first side and the second side, the inner arm assembly comprising a latch arm pivotable from a position above the latch surface to a position below the latch surface, the inner arm assembly comprising a bearing axle and an inner roller rotatable on the bearing axle;

a first roller connected to rotate on the first post;

a second roller connected to rotate on the second post; and at least one biasing mechanism biasing the latch arm towards the position above the latch surface; and first, second, and third rotating cam lobes respectively configured to press upon each of the first roller, the second roller, and the inner roller, wherein the bearing axle terminates in the inner arm assembly without extending into the first inner surface of the first side or the second inner surface of the second side, and wherein the third rotating cam lobe is configured to selectively push the latch arm to rotate past the latch surface when the latch finger is in the unlatched position.

17. The valvetrain of claim 16, wherein the latch arm is configured to latch against the latch surface when the latch finger is in the latched position and the latch arm is configured to rotate past the latch surface when the latch finger is in the unlatched position.

18. A rocker arm, comprising:

a first outer arm comprising a first inner surface and a first outer surface opposite to the first inner surface, the first outer arm further comprising a first cantilevered post extending from the first outer surface;

a first outer roller mounted to the first cantilevered post;

a second outer arm comprising a second inner surface and a second outer surface opposite to the second inner surface, the second inner surface facing the first inner surface, the second outer arm further comprising a second cantilevered post extending from the second outer surface;

a second outer roller mounted to the second cantilevered post;

a pivot body joining the first inner surface of the first outer arm and the second inner surface of the second outer arm;

an actuatable latch mechanism within the pivot body;

an inner arm assembly disposed between the first outer arm and the second outer arm and comprising a latch arm pivotable adjacent the pivot body, the inner arm assembly further comprising a bearing axle for rotatably supporting an inner roller between the first outer roller and the second outer roller, the bearing axle terminating in the inner arm assembly without extending into the first inner surface of the first outer arm or the second inner surface of the second outer arm; and a pivot axle joining the inner arm assembly to the first outer arm and the second outer arm to pivot between the first outer arm and the second outer arm.

19. The rocker arm of claim 18, further comprising a spring on the pivot axle and a valve pallet between the first outer arm and the second outer arm, wherein the inner arm assembly further comprises a spring prop, and wherein the spring is biased between the valve pallet and the spring prop.

20. The rocker arm of claim 19, wherein the spring is biased to push the latch arm above the actuatable latch mechanism.

21. The rocker arm of claim 18, further comprising a first spring mounted on the first outer arm and a second spring mounted on the second outer arm, wherein the first outer arm further comprises a first ledge, wherein the second outer side arm further comprises a second ledge, wherein the first spring is biased between the first ledge and the bearing axle, and wherein the second spring is biased between the second ledge and the bearing axle.

22. The rocker arm of claim 18, wherein the latch arm is adjacent the pivot body, and wherein the pivot axle is distal from the latch arm.

23. The rocker arm of claim 18, wherein the inner arm assembly is joined to the first outer arm and to the second outer arm only by the pivot axle.

24. The rocker arm of claim 18, further comprising a bushing press-fit to the first cantilevered post to mount the first outer roller to the first cantilevered post.

25. The rocker arm of claim 24, wherein the bushing is a "T" bushing comprising an extension, and wherein the extension provides travel limitation to the first outer roller.

26. The rocker arm of claim 25, further comprising bearings between the first cantilevered post and the first outer roller to form a bearing assembly.

27. The rocker arm of claim 18, further comprising a washer secured to the first cantilevered post by a fastener, the washer facilitating rotation of the first outer roller on the first cantilevered post.

28. The rocker arm of claim 18, further comprising a valve seat distal from the pivot body.

29. The rocker arm of claim 28, wherein the valve seat is integrally formed with the first outer arm and with the second outer arm.

30. The rocker arm of claim 28, wherein the valve seat is an insert on the pivot axle and within the inner arm assembly.

31. The rocker arm of claim 18, wherein the inner arm assembly comprises a rotatable bearing mounted on a bearing axle.

32. The rocker arm of claim 31, further comprising needles mounted between the bearing axle and the rotatable bearing to form a needle bearing.

33. The rocker arm of claim 31, wherein the first cantilevered post is in-line with the bearing axle.

34. The rocker arm of claim 18, wherein the first outer roller comprises a center hole, and wherein the first outer roller is mounted to the first cantilevered post by inserting a fastener through the center hole and by securing the fastener to the first cantilevered post.

35. The rocker arm of claim 34, wherein the first cantilevered post comprises a first post receptacle, and wherein the first outer roller is mounted to the first cantilevered post by inserting the fastener through the center hole and into the first post receptacle.

36. The rocker arm of claim 35, wherein the first post receptacle is threaded, and wherein the fastener is threaded.

37. The rocker arm of claim 34, further comprising a bushing between the first outer roller and the first cantilevered post.

38. The rocker arm of claim 23, wherein the first cantilevered post comprises an outer surface, and wherein a bushing is fitted to the outer surface.

39. A type II valvetrain, comprising:

a rocker arm comprising:

an outer arm assembly comprising:

a first outer arm comprising a first inner surface and a first outer surface opposite to the first inner surface, the first outer arm further comprising a first cantilevered post extending from the first outer surface;

a first outer roller mounted to the first cantilevered post;

a second outer arm comprising a second inner surface and a second outer surface opposite to the second inner surface, the second inner surface facing the first inner surface, the second outer arm further comprising a second cantilevered post extending from the second outer surface;

a second outer roller mounted to the second cantilevered post;

a pivot body joining the first inner surface of the first outer arm and the second inner surface of the second outer arm; and an actuatable latch mechanism within the pivot body;

an inner arm assembly disposed between the first outer arm and the second outer arm and comprising a latch arm pivotable adjacent the pivot body, the inner arm assembly further comprising a bearing axle for rotatably supporting an inner roller between the first outer roller and the second outer roller, the bearing axle terminating in the inner arm assembly without extending into the first inner surface of the first outer arm or the second inner surface of the second outer arm;

a pivot axle joining the inner arm assembly to the first outer arm and the second outer arm to pivot between the first outer arm and the second outer arm; and a biasing mechanism biased between the outer arm assembly and the inner arm assembly; and first, second, and third rotating cam lobes, wherein the first cam lobe is configured to press upon the first outer arm, wherein the second cam lobe is configured to press upon the second outer arm, and wherein the third cam lobe is configured to selectively push the latch arm to rotate past the actuatable latch mechanism when the actuatable latch mechanism is in an unlatched position, and wherein the biasing mechanism provides a spring force to bias the inner arm assembly towards the third cam lobe.

* * * * *